US007580839B2

(12) United States Patent
Tamura et al.

(10) Patent No.: US 7,580,839 B2
(45) Date of Patent: Aug. 25, 2009

(54) APPARATUS AND METHOD FOR VOICE CONVERSION USING ATTRIBUTE INFORMATION

(75) Inventors: Masatsune Tamura, Kanagawa (JP); Takehiko Kagoshima, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 315 days.

(21) Appl. No.: 11/533,122

(22) Filed: Sep. 19, 2006

(65) Prior Publication Data

US 2007/0168189 A1 Jul. 19, 2007

(30) Foreign Application Priority Data

Jan. 19, 2006 (JP) ..... 2006-011653

(51) Int. Cl.
*G10L 13/00* (2006.01)

(52) U.S. Cl. ..... 704/258; 704/254; 704/257; 704/246; 379/88.02

(58) Field of Classification Search ..... 704/258, 704/270, 254, 257, 220, 222, 246, 247, 232; 379/88.02
See application file for complete search history.

(56) References Cited

U.S. PATENT DOCUMENTS 5,327,521 A * 7/1994 Savic et al. ..... 704/272

(Continued)

FOREIGN PATENT DOCUMENTS

JP 2005-164749 6/2005

(Continued)

OTHER PUBLICATIONS

Yannis Stylianou, et al., "Continuous Probabilistic Transform for Voice Conversion", IEEE Transactions on Speech and Audio Processing, vol. 6, No. 2, Mar. 1998, pp. 131-142.

(Continued)

*Primary Examiner*—Vijay B Chawan
(74) *Attorney, Agent, or Firm*—Oblon, Spivak, McClelland, Maier & Neustadt, P.C.

(57) ABSTRACT

A speech processing apparatus according to an embodiment of the invention includes a conversion-source-speaker speech-unit database; a voice-conversion-rule-learning-data generating means; and a voice-conversion-rule learning means, with which it makes voice conversion rules. The voice-conversion-rule-learning-data generating means includes a conversion-target-speaker speech-unit extracting means; an attribute-information generating means; a conversion-source-speaker speech-unit database; and a conversion-source-speaker speech-unit selection means. The conversion-source-speaker speech-unit selection means selects conversion-source-speaker speech units corresponding to conversion-target-speaker speech units based on the mismatch between the attribute information of the conversion-target-speaker speech units and that of the conversion-source-speaker speech units, whereby the voice conversion rules are made from the selected pair of the conversion-target-speaker speech units and the conversion-source-speaker speech units.

13 Claims, 32 Drawing Sheets

U.S. PATENT DOCUMENTS

| | | | | |
|---|---|---|---|---|
| 6,336,092 | B1 * | 1/2002 | Gibson et al. | 704/268 |
| 6,405,166 | B1 * | 6/2002 | Huang et al. | 704/246 |
| 6,615,174 | B1 * | 9/2003 | Arslan et al. | 704/270 |
| 2005/0137870 | A1 * | 6/2005 | Mizutani et al. | 704/264 |
| 2006/0178874 | A1 * | 8/2006 | En-Najjary et al. | 704/207 |
| 2006/0235685 | A1 * | 10/2006 | Nurminen et al. | 704/235 |
| 2007/0185715 | A1 | 8/2007 | Wei et al. | |
| 2007/0208566 | A1 * | 9/2007 | En-Najjary et al. | 704/269 |

FOREIGN PATENT DOCUMENTS

| | | |
|---|---|---|
| JP | 2005-266349 | 9/2005 |
| KR | 2000-0008371 | 2/2000 |
| WO | 2006/082287 A1 | 8/2006 |

OTHER PUBLICATIONS

Masatsune Tamura, et al., "Scalable Concatenative Speech Synthesis Based on the Plural Unit Selection and Fusion Method", Acoustics Speech and Signal Processing, IEEE, vol. 1, XP010792049, Mar. 18-23, 2005, pp. I-361 to I-364.

U.S. Appl. No. 12/193,530, filed Aug. 18, 2008, Mizutani, et al.

* cited by examiner

VOICE-CONVERSION-RULE MAKING APPARETUS

LABELING

PITCH MARKING

FIG. 5

CONVERSION-TARGET-SPEAKER ATTRIBUTE INFORMATION

| PHONEME (SPEECH UNIT NAME) | FUNDAMENTAL FREQUENCY (Hz) | PHONEME DURATION (msec) | CONCATENATION BOUNDARY CEPSTRUM | PHONEME ENVIRONMENT |
|---|---|---|---|---|
| : | : | : | : | : |
| /n-right/ | 291.5 | 24.9 | $c_0(1), c_0(T)$ | a-n-a |
| /a-left/ | 321.8 | 42.4 | $c_1(1), c_1(T)$ | n-a-s |
| /a-right/ | 311.1 | 42.4 | $c_2(1), c_2(T)$ | n-a-s |
| : | : | : | : | : |

CONVERSION-SOURCE-SPEAKER SPEECH UNIT

| SPEECH UNIT NO. | SPEECH UNIT WAVEFORM |
|---|---|
| 0 |  |
| 1 |  |
| 2 |  |
| ⋮ | ⋮ |

FIG. 7

CONVERSION-SOURCE-SPEAKER ATTRIBUTE INFORMATION

| SPEECH UNIT No. | PHONEME (HALF PHONEME AME) | FUNDAMENTAL FREQUENCY (Hz) | PHONEME DURATION (msec) | CONCATENATION BOUNDARY CEPSTRUM | PHONEME ENVIRONMENT |
|---|---|---|---|---|---|
| 0 | /a-left/ | 308.6 | 74.0 | $c_0(1), c_0(T)$ | m-a-k |
| 1 | /a-right/ | 300.5 | 65.4 | $c_1(1), c_1(T)$ | n-a-d |
| 2 | /i-left/ | 334.6 | 69.5 | $c_2(1), c_2(T)$ | a-i-s |
| : | : | : | : | : | : |

$$y = p(m_1 \mid x)A^1x' + p(m_2 \mid x)A^2x' + p(m_3 \mid x)A^3x'$$
$$= 0.3A^1x' + 0.6A^2x' + 0.1A^3x'$$

VOICE CONVERSION APPARATUS

VOICE CONVERSION APPARATUS

APPARATUS AND METHOD FOR VOICE CONVERSION USING ATTRIBUTE INFORMATION

CROSS-REFERENCE TO RELATED APPLICATIONS

This application is based upon and claims the benefit of priority from the prior Japanese Patent Application No. 2006-11653, filed on Jan. 19, 2006; the entire contents of which are incorporated herein by reference.

BACKGROUND

1. Field of the Invention

The present invention relates to an apparatus and a method of processing speech in which rules for converting the speech of a conversion-source speaker to that of a conversion-target speaker are made.

2. Description of the Related Art

A technique of inputting the speech of a conversion-source speaker and converting the voice quality to that of a conversion-target speaker is called a voice conversion technique. In this voice conversion technique, speech spectrum information is expressed as parameters, and voice conversion rules are learned from the relationship between the spectrum parameters of the conversion-source speaker and the spectrum parameters of the conversion-target speaker. Any input speech of the conversion-source speaker is analyzed to obtain spectrum parameters, which are converted to those of the conversion-target speaker by application of the voice conversion rules, and a speech waveform is synthesized from the obtained spectrum parameters. The voice quality of the input speech is thus converted to the voice quality of the conversion-target speaker.

One method of the voice conversion is a method of voice conversion in which conversion rules are learned based on a Gaussian mixture model (GMM). (e.g., refer to Nonpatent Document 1: Y. Stylianou, et al., "Continuous Probabilistic Transform for Voice Conversion" IEEE TRANSACTIONS ON SPEECH AND AUDIO PROCESSING, Vol. 6, No. 2, March, 1998). In this case, a GMM is obtained from the speech spectrum parameters of a conversion-source speaker, and a regression matrix of each mixture of the GMM is obtained by a regression analysis using a pair of the spectrum parameters of the conversion-source speaker and the spectrum parameters of the conversion-target speaker to thereby make voice conversion rules. For voice conversion, the regression matrix is weighted by the probability that the spectrum parameters of the input speech are output in each mixture of the GMM. This makes the conversion rules continuous, allowing natural voice conversion. In this way, conversion rules are learned from a pair of the speech of the conversion-source speaker and the speech of the conversion-target speaker. In Nonpatent Document 1, speech data of two speakers in the unit of short phonetic unit are associated with each other by dynamic time warping (DTW) to form conversion-rule learning data. With the known voice-conversion-rule making apparatus, as disclosed in Nonpatent Document 1, speech data of the same content of a conversion-source speaker and a conversion-target speaker are associated with each other, from which conversion rules are learned.

Inputting any sentence to generate a speech waveform is referred to as text-to-speech synthesis. The text-to-speech synthesis is generally performed by three steps by a language processing means, a prosody processing means, and a speech synthesizing means. Input text is first subjected to a morphological analysis and a syntax analysis by the language processing means, and is then processed for accent and intonation by the prosody processing means, whereby phoneme sequence and prosodic information (fundamental frequency, phoneme duration, etc.) are output. Finally, the speech-waveform generating means generates a speech waveform according to the phoneme sequence and prosodic information. One of speech synthesis methods is of a speech-unit selection type which selects a speech unit from a speech unit database containing a lot of speech units, and synthesizes them toward the goal of the input phoneme sequence and prosodic information. The speech synthesis of the speech-unit selection type is such that speech units are selected from the stored mass speech units according to the input phoneme sequence and prosodic information, and the selected speech units are concatenated to synthesize speech. Another speech synthesis method of a plural-unit selection type is such that a plurality of speech units are selected for each synthesis units in an input phoneme sequence according to the degree of the distortion of synthetic speech toward the target of the input phoneme sequence and prosodic information, and the selected speech units are fused to generate new speech units, and the speech units are concatenated to synthesize speech (e.g., refer to Japanese Application KOKAI 2005-164749). An example of the method of fusing speech units is a method of averaging pitch-cycle waveforms.

Suppose voice conversion of a speech-unit database of text-to-speech synthesis using a low volume of speech data of a conversion-target speaker. This enables speech synthesis of any sentence using the voice quality of a conversion-target speaker having limited speech data. In order to apply the method disclosed in the above-mentioned Nonpatent Document 1 to this voice conversion, speech data of the same contents of the conversion-source speaker and the conversion-target speaker must be prepared, with which voice conversion rules are made. Accordingly, by the method disclosed in Nonpatent Document 1, when voice conversion rules are learned using mass speech data of a conversion-source speaker and low-volume speech data of conversion-target speaker, the speech contents in the speech data for use in learning voice conversion rules is limited, so that only the limited speech contents are used to learn voice conversion rules although there is a mass speech unit database of the conversion-source speaker. This disables learning of voice conversion rules reflecting the information contained in the mass speech segment database of the conversion-source speaker.

As has been described, the related art has the problem that when voice conversion rules are learned using mass speech data of a conversion-source speaker and low-volume speech data of a conversion-target speaker, the speech contents of the speech data for use as learning data is limited, thus preventing learning of voice conversion rules reflecting the information contained in the mass speech unit database of the conversion-source speaker.

SUMMARY

It is an object of the present invention to provide an apparatus and a method of processing speech which are capable of making voice conversion rules using any speech of a conversion-target speaker.

A speech processing apparatus according to embodiments of the present invention includes: a conversion-source-speaker speech storing means configured to store information on a plurality of speech units of a conversion-source speaker and source-speaker attribute information corresponding to the speech units; a speech-unit extracting means configured to divide the speech of a conversion-target speaker into any types of speech units to form target-speaker speech units; an attribute-information generating means configured to generate target-speaker attribute information corresponding to the target-speaker speech units from information on the speech of the conversion-target speaker or linguistic information of the speech; a conversion-source-speaker speech-unit selection means configured to calculate costs on the target-speaker attribute information and the source-speaker attribute information using cost functions, and selecting one or a plurality of speech units from the conversion-source-speaker speech storing means according to the costs to form a source-speaker speech unit; and a voice-conversion-rule making means configured to make speech conversion functions for converting the one or the plurality of source-speaker speech units to the target-speaker speech units based on the target-speaker speech units and the one or the plurality of source-speaker speech units.

According to embodiments of the invention, voice conversion rules can be made using the speech of any sentence of a conversion-target speaker.

BRIEF DESCRIPTION OF THE DRAWINGS

FIG. 5 is a diagram showing examples of attribute information generated by an attribute-information generating means;

FIG. 7 is a diagram showing examples of attribute information contained in the speech unit database;

DETAILED DESCRIPTION

Embodiments of the invention will be described hereinbelow.

FIRST EMBODIMENT

Referring to FIGS. 1 to 21, a voice-conversion-rule making apparatus according to a first embodiment of the invention will be described.

(1) Structure of Voice-Conversion-Rule Making Apparatus

Figure 1:
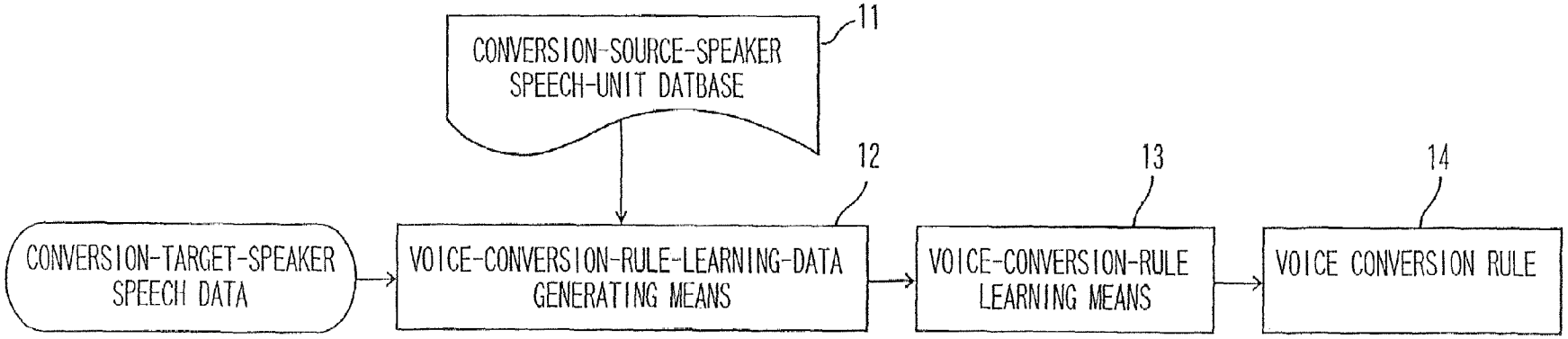
FIG. 1 is a block diagram of a voice-conversion-rule making apparatus according to a first embodiment of the invention.

FIG. 1 is a block diagram of a voice-conversion-rule making apparatus according to the first embodiment.

The voice-conversion-rule making apparatus includes a conversion-source-speaker speech-unit database 11, a voice-conversion-rule-learning-data generating means 12, and a voice-conversion-rule learning means 13 to make voice conversion rules 14.

The voice-conversion-rule-learning-data generating means 12 inputs speech data of a conversion-target speaker, selects a speech unit of a conversion-source speaker from the conversion-source-speaker speech-unit database 11 for each of the speech units divided in any types of speech units, and makes a pair of the speech units of the conversion-target speaker and the speech units of the conversion-source speaker as learning data.

The voice-conversion-rule learning means 13 learns the voice conversion rules 14 using the learning data generated by the voice-conversion-rule-learning-data generating means 12.

(2) Voice-Conversion-Rule-Learning-Data Generating Means 12

Figure 2:
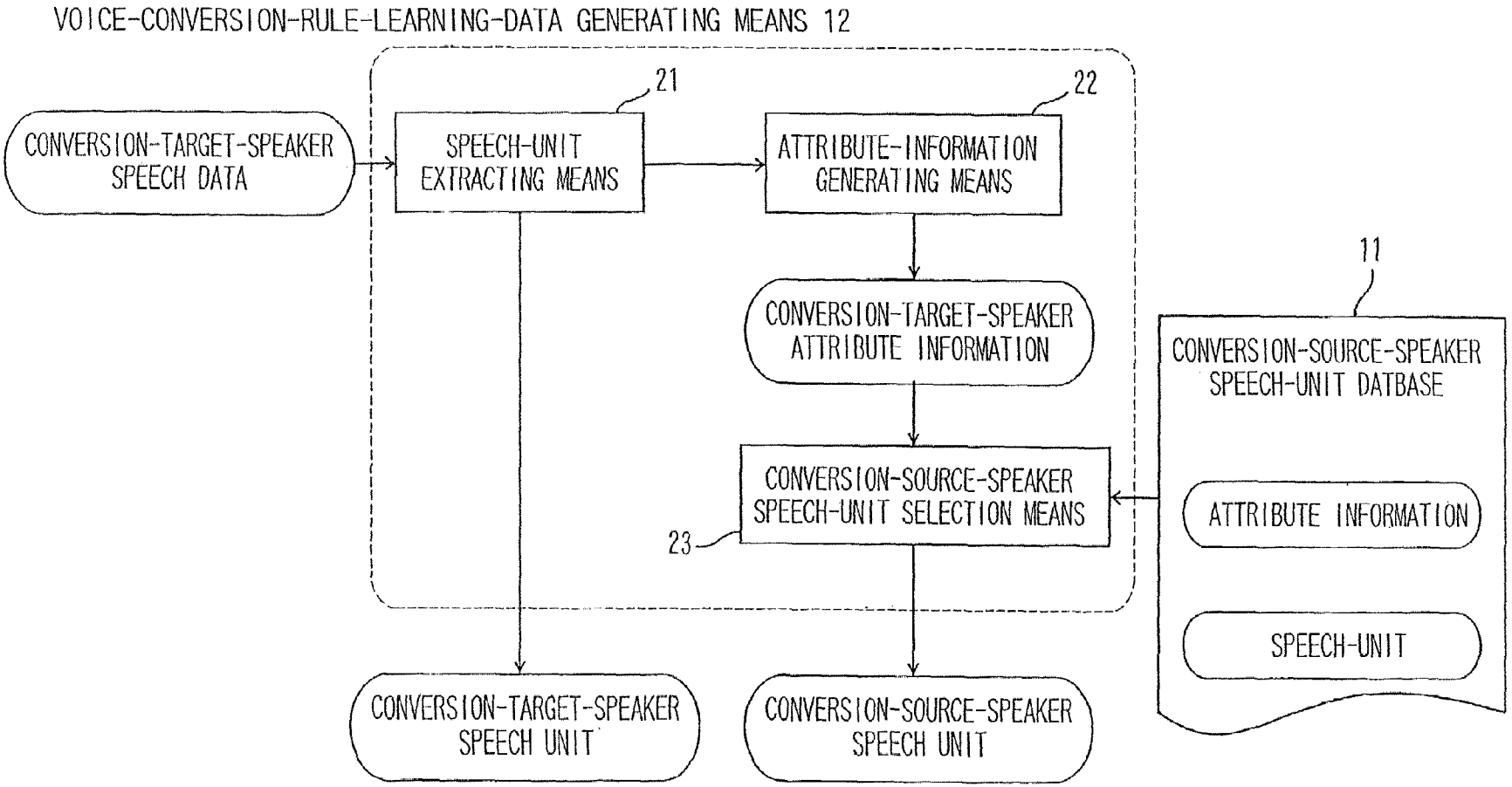
FIG. 2 is a block diagram showing the structure of a voice-conversion-rule-learning-data generating means.

FIG. 2 shows the structure of the voice-conversion-rule-learning-data generating means 12.

A speech-unit extracting means 21 divides the speech data of the conversion-target speaker into speech units in any types of speech unit to extract conversion-target-speaker speech units.

An attribute-information generating means 22 generates attribute information corresponding to the extracted conversion-target-speaker speech units.

A conversion-source-speaker speech-unit selection means 23 selects conversion-source-speaker speech-units corresponding to the conversion-target-speaker speech units according to a cost function indicative of the mismatch between the attribute information of the conversion-target-speaker speech units and attribute information of the conversion-source-speaker speech units contained in the conversion-source-speaker speech-unit database.

The selected pair of the conversion-target-speaker speech units and the conversion-source-speaker speech units is used as voice-conversion-rule learning data.

The process of the voice-conversion-rule-learning-data generating means 12 will be specifically described.

(2-1) Speech-Unit Extracting Means 21

The speech-unit extracting means 21 extracts speech units in any types of speech unit from the conversion-target-speaker speech data. The type of speech unit is a sequence of phonemes or divided phonemes; for example, half phonemes, phonemes (C, V), diphones (CV, VC, VV), triphones (CVC, VCV), syllables (CV, V) (V indicates a vowel and C indicates a consonant), and variable-length mixtures thereof.

Figure 3:
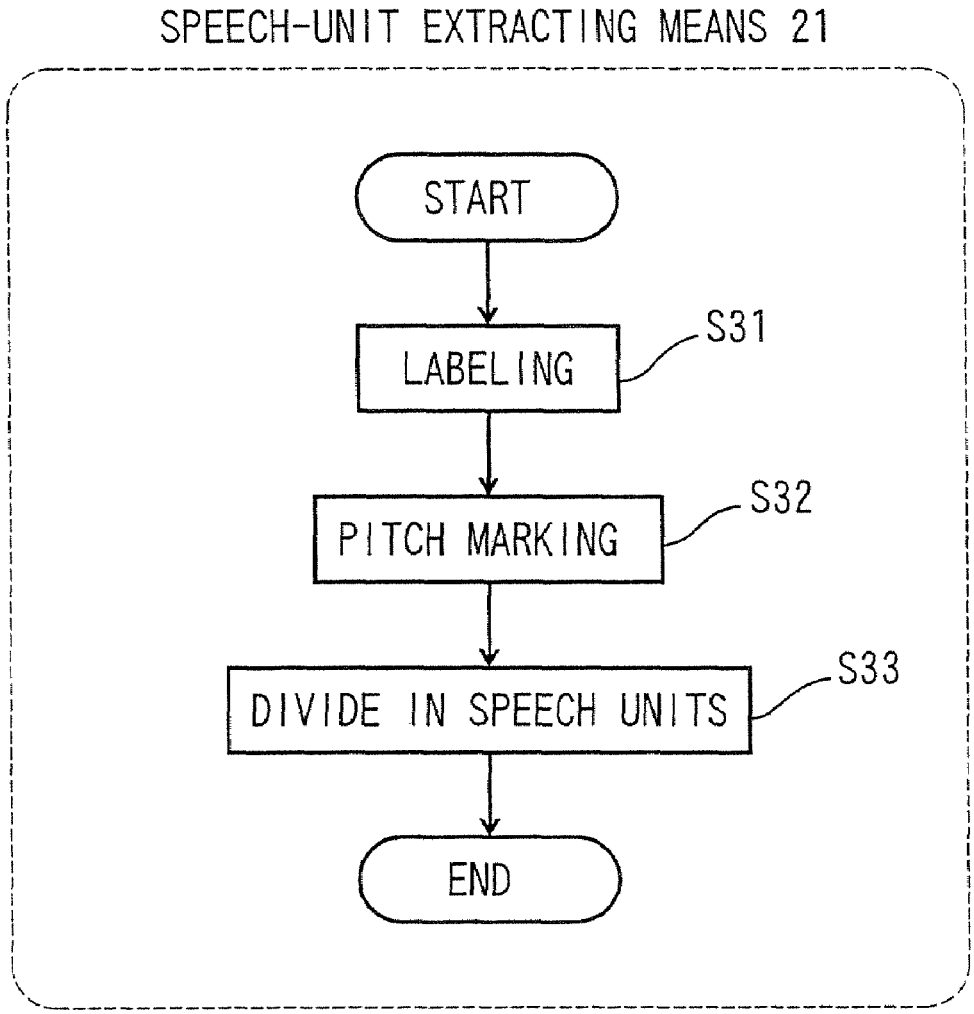
FIG. 3 is a flowchart for the process of a speech-unit extracting means.

FIG. 3 is a flowchart for the process of the speech-unit extracting means 21.

In step S31, the input conversion-target-speaker speech data is labeled by phoneme unit or the like.

In step S32, pitch marks are placed thereon.

In step S33, the input speech data are divided into speech units corresponding to any type of speech unit.

Figure 4A:
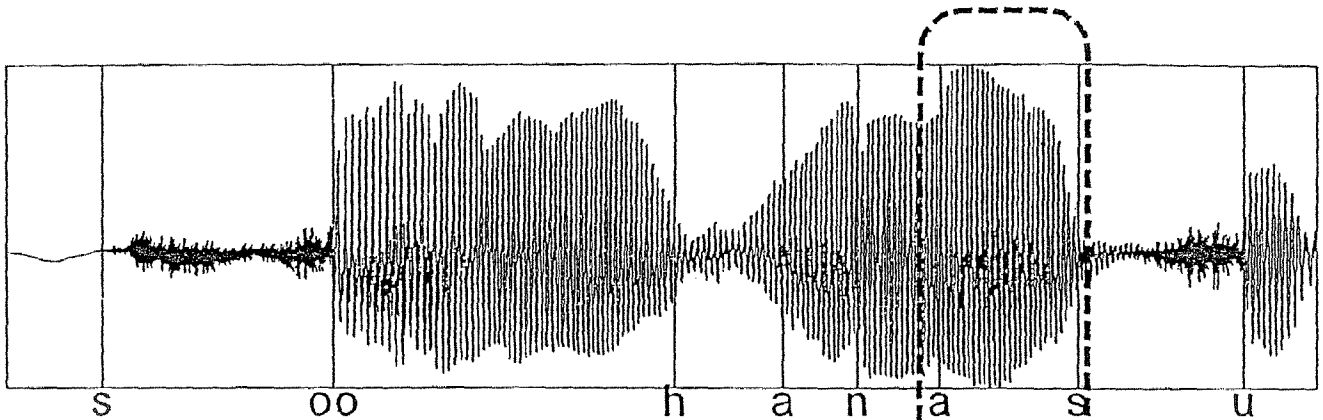
FIG. 4A is a diagram showing an example of labeling of the speech-unit extracting means.
Figure 4B:
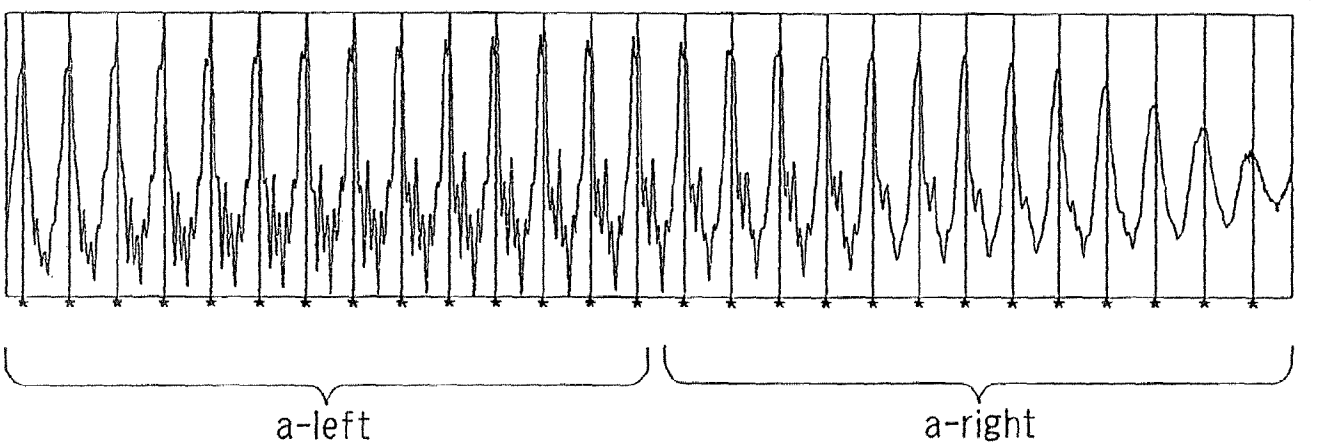
FIG. 4B is a diagram showing an example of pitch marking of the speech-unit extracting section.

FIGS. 4A and 4B show examples of labeling and pitch marking to a sentence "so-o-ha-na-su". FIG. 4A shows an example of labeling the boundaries of the segments of speech data; and FIG. 4B shows an example of pitch marking to part "a".

The labeling means putting a label indicative of a phoneme type of speech units and the boundary between speech units, which is performed by a method using a hidden Markov model or the like. The labeling may be made either automatically or manually. The pitch marking means marking in synchronization with the fundamental frequency of speech, which is performed by a method of extracting peaks of waveform, or the like.

Thus, the speech data is divided into speech units by labeling and pitch marking. When a half phoneme is the type of speech unit, the waveform is divided at the boundary between the phonemes and the center of the phoneme into "a left speech unit of part a (a-left)" and "a right speech unit of part a (a-right)".

(2-2) Attribute-Information Generating Means 22

The attribute-information generating means 22 generates attribute information corresponding to the speech units extracted by the speech-unit extracting means 21. The attributes of the speech unit include fundamental-frequency information, phoneme duration information, phoneme-environment information, and spectrum information.

FIG. 5 shows examples of the conversion-target-speaker attribute information: fundamental-frequency information, phoneme duration information, the cepstrum at concatenation boundary, and phoneme environment. The fundamental frequency is the mean (Hz) of the frequencies of the speech units, the phoneme duration is expressed in the unit msec, the spectrum parameter is the cepstrum at concatenation boundary, and the phoneme environment is the preceding and the succeeding phonemes.

The fundamental frequency is obtained by extracting the pitch of the speech with, e.g., an autocorrelation function and averaging the frequencies of the speech unit. The cepstrum or the spectrum information is obtained by analyzing the pitch-cycle waveform at the end of the boundary of speech units.

The phoneme environment includes the kind of the preceding phoneme and the kind of the succeeding phoneme. Thus the speech unit of the conversion-target speaker and corresponding conversion-target-speaker attribute information can be obtained.

(2-3) Conversion-Source-Speaker Speech-Unit Database 11

The conversion-source-speaker speech-unit database 11 stores speech-unit and attribute information generated from the speech data of the conversion-source speaker. The speech-unit and attribute information are the same as those obtained by the speech-unit extracting means 21 and the attribute-information generating means 22.

Figure 6:
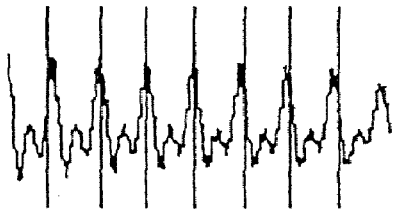
FIG. 6 is a diagram showing examples of speech units contained in a speech unit database.
Figure 6:
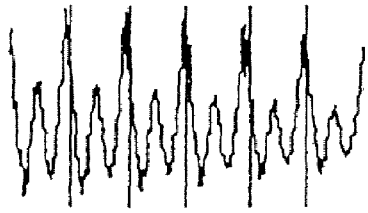
Figure 6:
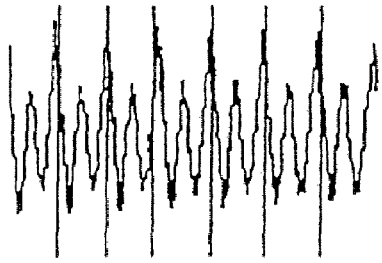

Referring to FIG. 6, the conversion-source-speaker speech-unit database 11 stores the pitch-marked waveforms of speech units of the conversion-source speaker in association with numbers for identifying the speech units.

Referring to FIG. 7, the conversion-source-speaker speech-unit database 11 also stores the attribute information of the speech units in association with the numbers of the speech units.

The information of the speech units and attributes is generated from the speech data of the conversion-source speaker by the process of labeling, pitch marking, attribute generation, and unit extraction, as in the process of the speech-unit extracting means 21 and the attribute-information generating means 22.

(2-4) Conversion-Source-Speaker Speech-Unit Selection Means 23

The conversion-source-speaker speech-unit selection means 23 expresses the mismatch between the speech-unit attribute information of the conversion-target speaker and the attribute information of the conversion-source speaker as a cost function, and selects a speech unit of the conversion-source speaker in which the cost is the smallest relative to that of the conversion-target speaker.

(2-4-1) Cost Function

The cost function is expressed as a subcost function $C_n(u_t, u_c)$ (n: 1 to N, where N is the number of the subcost functions) every attribute information, where $u_t$ is the speech unit of the conversion-target speaker, $u_c$ is a speech unit with the same phoneme as $u_t$ out of the conversion-source-speaker speech units contained in the conversion-source-speaker speech-unit database 11.

The subcost functions include a fundamental-frequency cost $C_1(u_t, u_c)$ indicative of the difference between the fundamental frequencies of the speech units of the conversion-target speaker and those of the conversion-source speaker, a phoneme-duration cost $C_2(u_t, u_c)$ indicative of the difference in phoneme duration, spectrum costs $C_3(u_t, u_c)$ and $C_4(u_t, u_c)$ indicative of the difference in spectrum at the boundary of speech units, phoneme environment costs $C_5(u_t, u_c)$ and $C_6(u_t, u_c)$ indicative of the difference in phoneme environment.

Specifically speaking, the fundamental frequency cost is calculated as a difference in logarithmic fundamental frequency by the equation:

$$C_1(u_t,u_c)=\{\log(f(u_t))-\log(f(u_c))\}^2 \quad (1)$$

where f(u) is a function for extracting an average fundamental frequency from attribute information corresponding to a speech unit u.

The phoneme duration cost is expressed as:

$$C_2(u_t,u_c)=\{g(u_t)-g(u_c)\}^2 \quad (2)$$

where g(u) is a function for extracting phoneme duration from attribute information corresponding to the speech unit u.

The spectrum cost is calculated from a cepstrum distance at the boundary between speech units by the equation:

$$C_3(u_t,u_c)=\|h^l(u_t)-h^l(u_c)\|$$

$$C_4(u_t,u_c)=\|h^r(u_t)-h^r(u_c)\| \quad (3)$$

where $h^l(u)$ is a function for extracting the cepstrum coefficient of a left boundary of the speech unit u, and $h^r(u)$ is a function for extracting the cepstrum coefficient of a right boundary as a vector, respectively.

The phoneme environment cost is calculated from a distance indicative of whether adjacent speech units are equal by the equation:

$$C_S(u_t, u_c) = \begin{cases} 0 & \cdots \text{ Left phoneme environments match} \\ 1 & \cdots \text{ The other} \end{cases} \quad (4)$$

$$C_S(u_t, u_c) = \begin{cases} 0 & \cdots \text{ Right phoneme environments match} \\ 1 & \cdots \text{ The other} \end{cases}$$

The cost function indicative of the mismatch between the speech unit of the conversion-target speaker and the speech unit of the conversion-source speaker is defined as the weighted sum of the subcost functions.

$$C(u_t, u_c) = \sum_{n=1}^{N} w_n C_n(u_t, u_c) \quad (5)$$

where $w_n$ is the weight of the subcost function. In the embodiment, $w_n$ is all set to "1" for the sake of simplicity. Eq. (5) is the cost function of a speech unit, which indicates a mismatch when a speech unit in the conversion-source-speaker speech-unit database is brought into correspondence with a conversion-target-speaker speech unit.

(2-4-2) Details of Process

Figure 8:
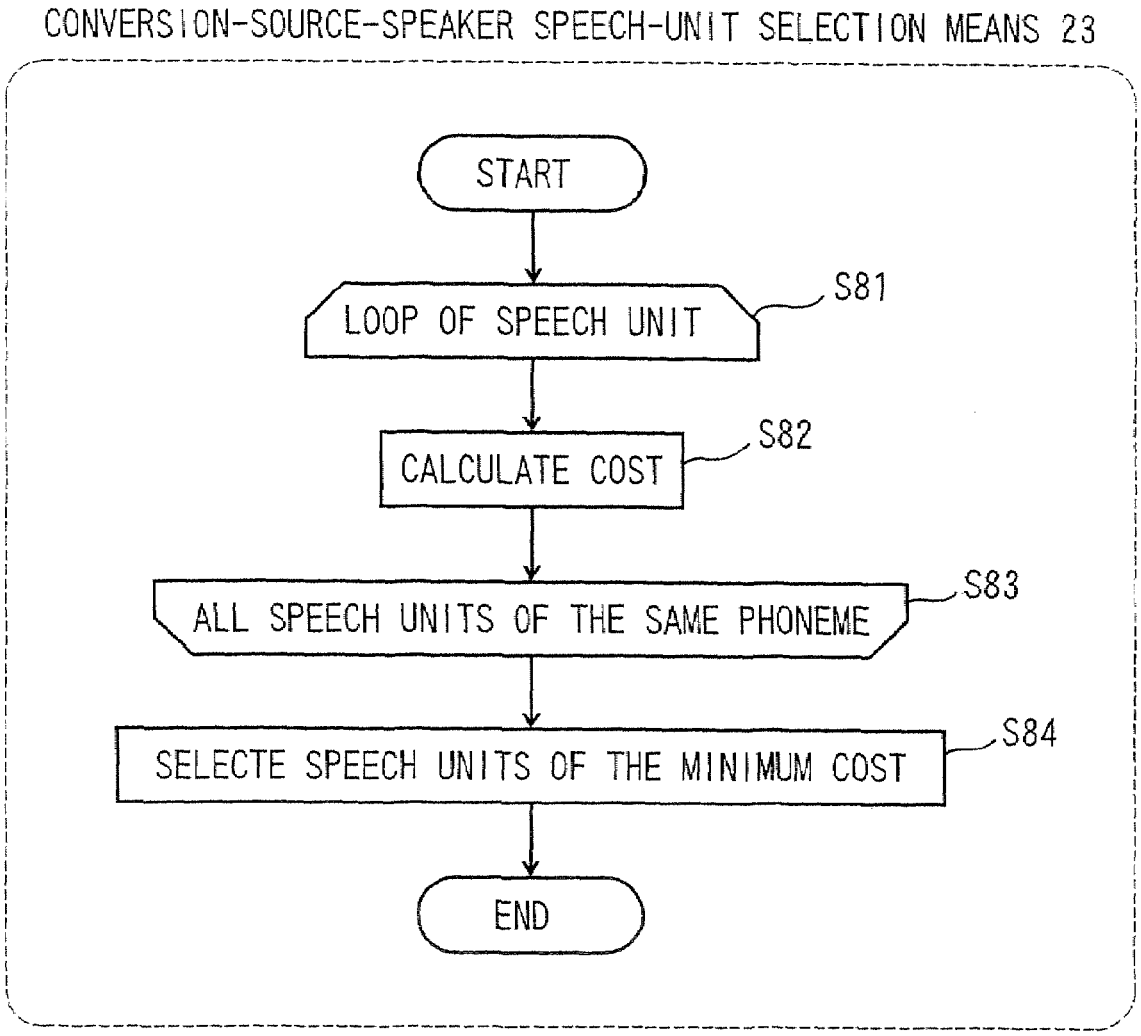
FIG. 8 is a flowchart for the process of a conversion-source-speaker speech-unit selection means.

The conversion-source-speaker speech-unit selection means 23 selects a conversion-source-speaker speech unit corresponding to a conversion-target-speaker speech unit using the above-described cost functions. The process is shown in FIG. 8.

In steps S81 to S83, all speech units of the same phoneme as that of the conversion-target speaker, contained in the conversion-source-speaker speech-unit database, are looped to calculate cost functions. Here the same phoneme indicates that corresponding speech units have the same kind of phoneme; for half phoneme, "the left speech segment of part a" or "a right speech segment of part i" has the same kind of phoneme.

In steps S81 to S83, the costs of all the conversion-source-speaker speech units of the same phoneme as the conversion-target-speaker speech units are determined.

In step S84, a conversion-source-speaker speech unit whose costs are the minimum is selected therefrom.

Thus a pair of learning data of the conversion-target-speaker speech unit and the conversion-source-speaker speech unit is obtained.

(2-4-3) Details of Other Processes

Although the conversion-source-speaker speech-unit selection means 23 of FIG. 8 selects one optimum speech unit whose costs are the minimum for the conversion-target-speaker speech units, a plurality of speech units may be selected.

Figure 9:
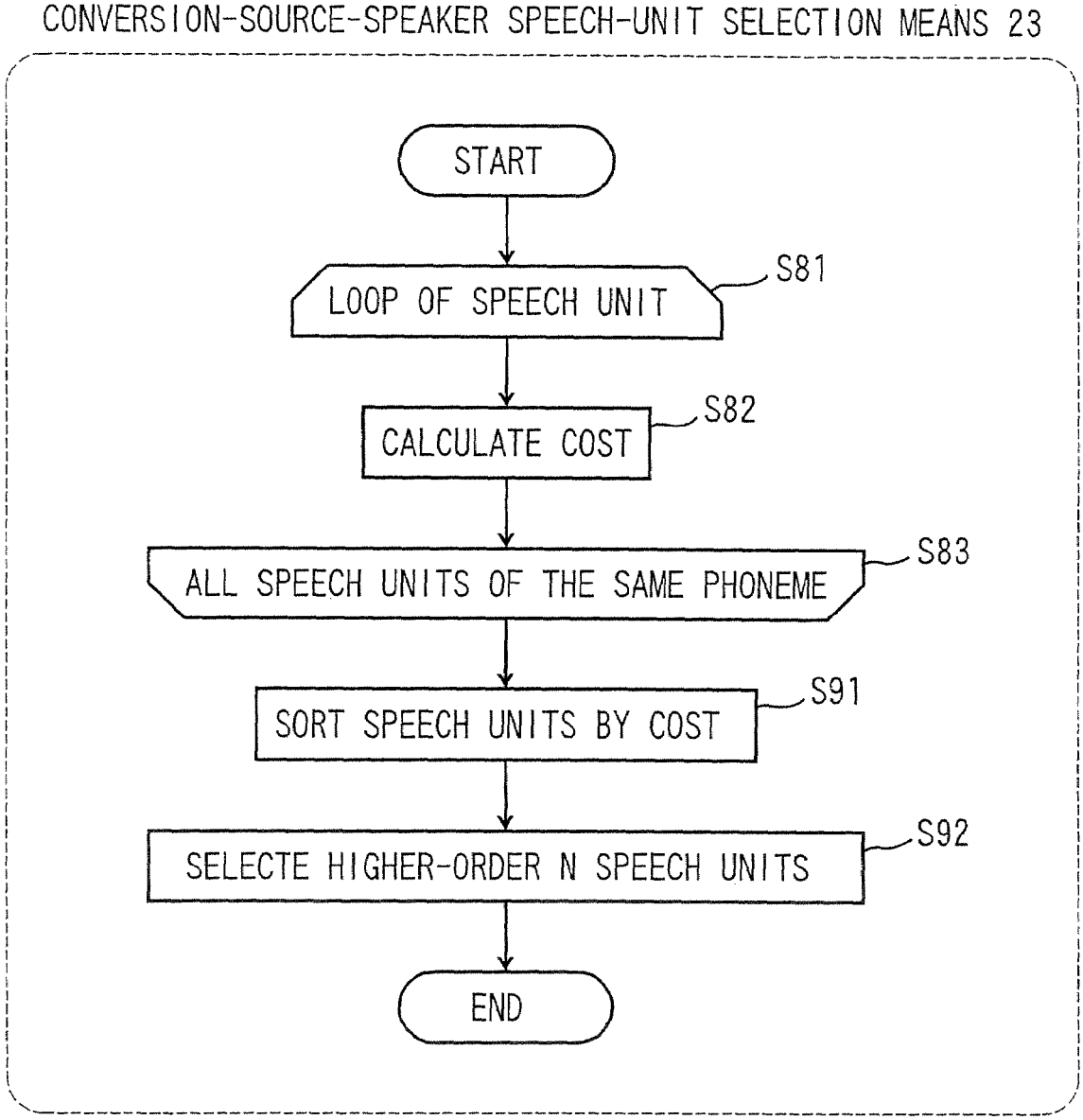
FIG. 9 is a flowchart for the process of the conversion-source-speaker speech-unit selection means.

In this case, the conversion-source-speaker speech-unit selection means 23 selects the higher-order N conversion-source-speaker speech units from the speech units of the same phoneme contained in the conversion-source-speaker speech-unit database in ascending order of the cost value by the process shown in FIG. 9.

In steps S81 to S83, all speech units of the same phoneme as those of the conversion-target speaker which are contained in the conversion-source-speaker speech-unit database are looped to calculate cost functions.

Then, in step S91, the speech units are sorted according to the costs and, in step S92, the higher-order N speech units are selected in ascending order of the costs.

Thus N conversion-source-speaker speech units can be selected for one conversion-target-speaker speech unit, and each of the conversion-source-speaker speech units and the corresponding conversion-target-speaker speech unit are paired to form learning data.

The use of the plurality of conversion-source-speaker speech units for each conversion-target-speaker speech unit reduces a bad influence due to the mismatch of the conversion-source-speaker speech unit and the conversion-target-speaker speech unit, and increases learning data, enabling learning of more stable conversion rules.

(3) Voice-Conversion-Rule Learning Means 13

The voice-conversion-rule learning means 13 will be described.

The voice-conversion-rule learning means 13 learns the voice conversion rules 14 using the pair of the conversion-source-speaker speech unit and the conversion-target-speaker speech unit which is learned by the voice-conversion-rule-learning-data generating means 12. The voice-conversion rules include voice conversion rules based on translation, simple linear regression analysis, multiple regression analysis, and vector quantization (VQ); and voice conversion rules based on the GMM shown in Nonpatent Document 1.

(3-1) Details of the Process

Figure 10:
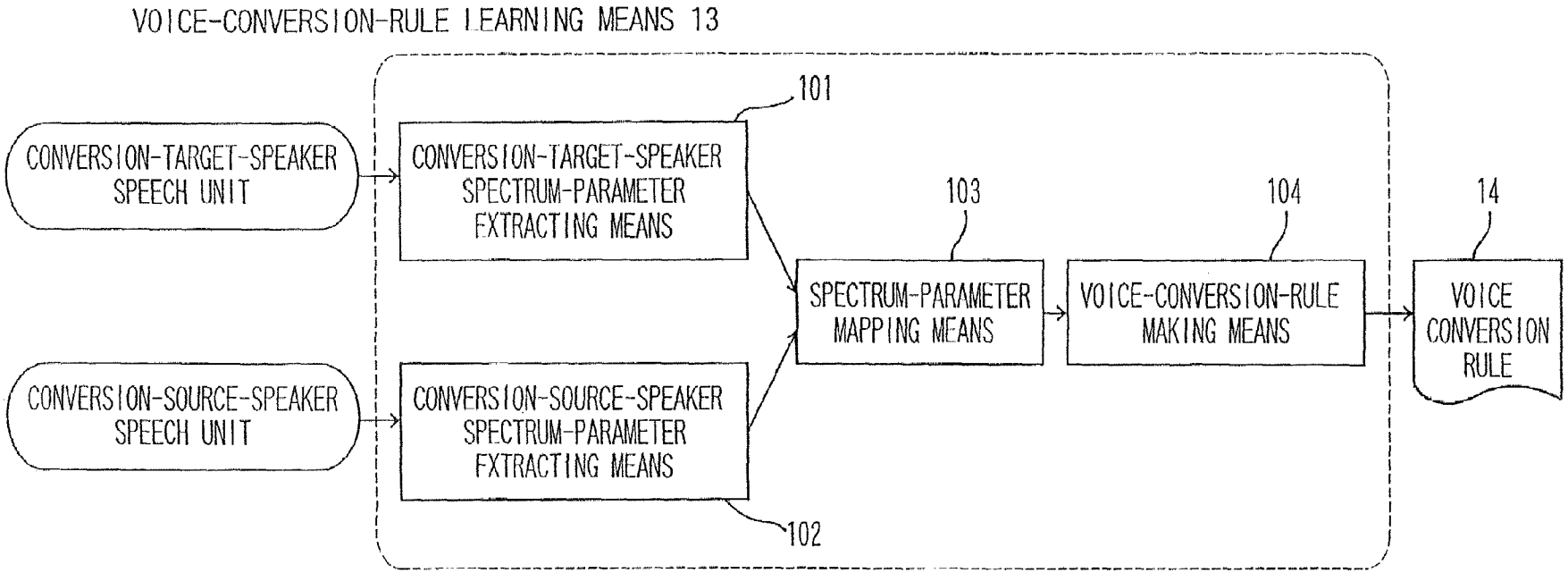
FIG. 10 is a block diagram showing the structure of a voice-conversion-rule learning means.

FIG. 10 shows the process of the voice-conversion-rule learning means 13.

A conversion-target-speaker spectrum-parameter extracting means 101 and a conversion-source-speaker spectrum-parameter extracting means 102 extract spectrum parameters of learning data. The spectrum parameters indicate information on the spectrum envelope of speech units: for example, an LPC coefficient, an LSF parameter, and mel-cepstrum. The spectrum parameters are obtained by pitch synchronous analysis. Specifically, pitch-cycle waveforms are extracted by applying a Hanning window of two times of the pitch, with each pitch mark of the speech unit as the center, whereby spectrum parameters are obtained from the extracted pitch-cycle waveforms.

One of the spectrum parameters, mel-cepstrum, is obtained by a method of regularized discrete cepstrum (O. Cappe et al., "Regularization Techniques for Discrete Cepstrum Estimation" IEEE Signal Processing Letters, Vol. 3, No. 3, No. 4, April 1996), a method of unbiased estimation (Takao Kobayashi, "Speech Cepstrum Analysis and Mel-Cepstrum Analysis", Technical Report of The Institute of Electronic Information and Communication Engineers, DSP98-77/SP98-56, pp. 33-40, September, 1998), etc., the entire contents thereof are incorporated herein by reference.

After the spectrum parameters have been obtained by the pitch marking of the conversion-source-speaker speech units and the conversion-target-speaker speech units, the spectrum parameters are mapped by a spectrum-parameter mapping means 103.

Since the conversion-source-speaker speech units and the conversion-target-speaker speech units have different number of pitch-cycle waveforms, the spectrum-parameter mapping means 103 completes the number of pitch-cycle waveforms. This is performed in such a manner that the spectrum parameters of the conversion-target speaker and those of the conversion-source speaker are temporally associated with each other by dynamic time warping (DTW), linear mapping, or mapping with a piecewise linear function.

Figure 11:
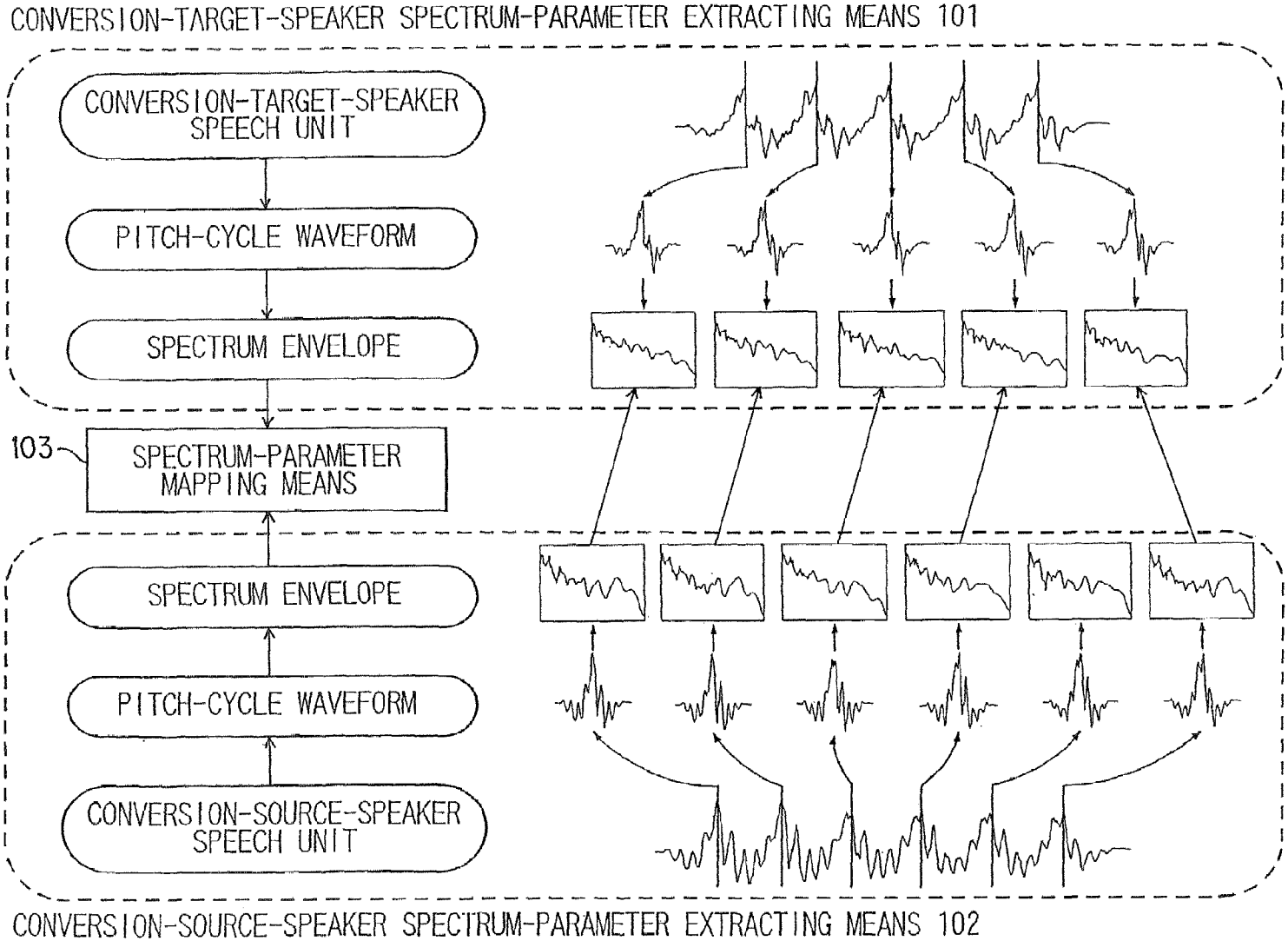
FIG. 11 is a diagram showing and example of the process of the voice-conversion-rule learning means.

As a result, the spectrum parameters of the conversion-source speaker can be associated with those of the conversion-target speaker. This process is illustrated in FIG. 11. FIG. 11 shows conversion-target-speaker speech units and their pitch marks, pitch-cycle waveforms cut out by a Hanning window, and spectrum envelopes obtained from spectrum parameters obtained by spectrum analysis of the pitch-cycle waveforms from the top, and shows conversion-source-speaker speech units, pitch-cycle waveforms, and spectrum envelopes from the bottom. The spectrum-parameter mapping means 103 of FIG. 10 brings the conversion-source-speaker speech units and the conversion-target-speaker speech units into one-to-one correspondence to obtain a pair of the spectrum parameters, thereby obtaining voice-conversion-rule learning data.

A voice-conversion-rule making means 104 learns voice conversion rules using the pair of the spectrum parameters of the conversion-source speaker and the conversion-target speaker as learning data.

(3-2) Voice Conversion Rules

Voice conversion rules based on translation, simple linear regression analysis, multiple regression analysis, and vector quantization (VQ); and voice conversion rules based on the GMM will be described.

(3-2-1) Translation

Figure 12:
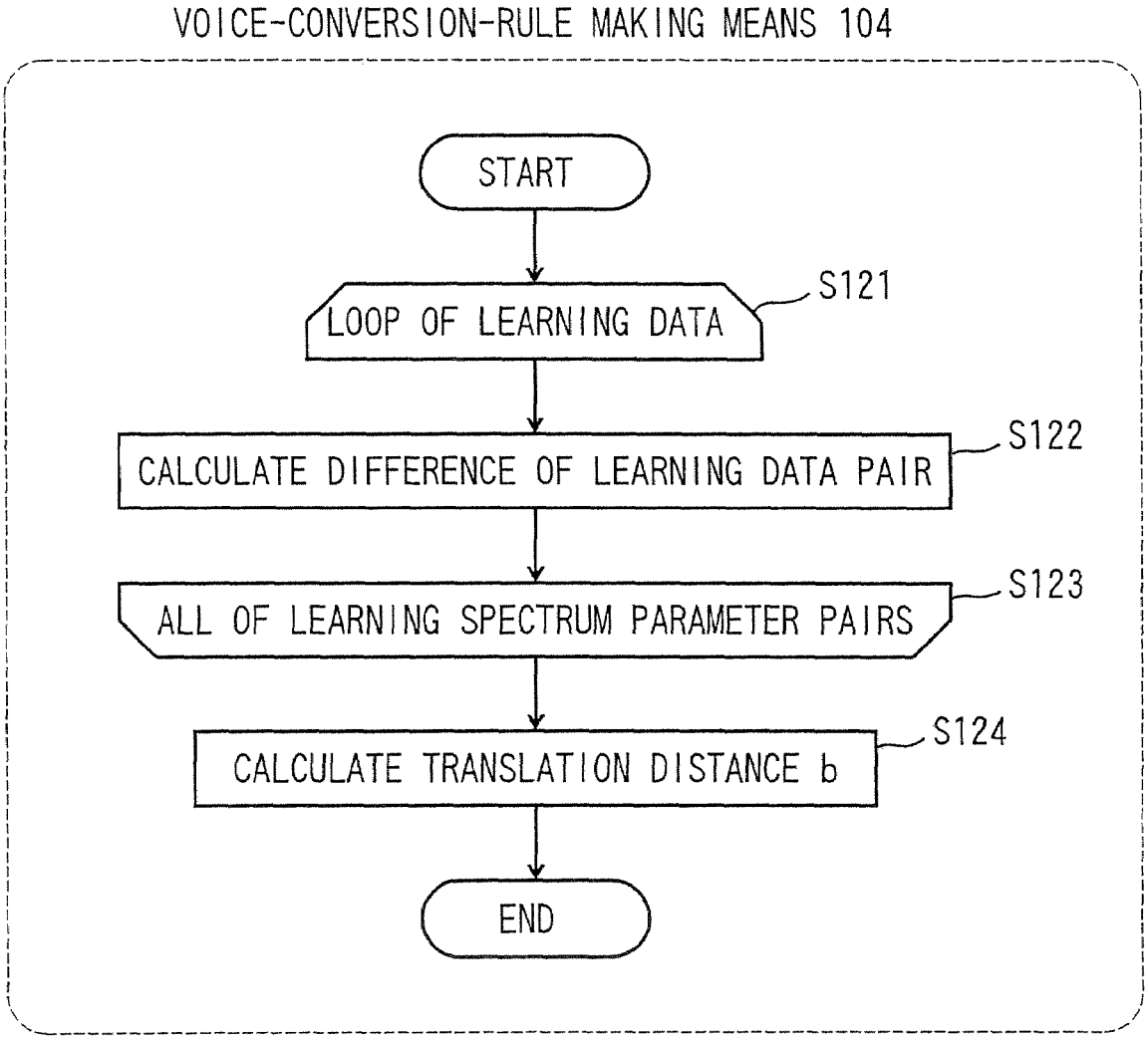
FIG. 12 is a flowchart for the process of a voice-conversion-rule making means.

FIG. 12 shows the process of the voice-conversion-rule making means 104 using translation.

For the translation, the voice conversion rule is expressed as the equation:

$$y'=x+b \tag{6}$$

where y' is a spectrum parameter after conversion, x is a spectrum parameter of the conversion-source speaker, and b is a translation distance. The translation distance b is found from the spectrum parameter pair or learning data by the equation:

$$b=\frac{1}{N}\sum_{i=1}^{N}(y_i-x_i) \tag{7}$$

where N is the number of learning spectrum parameter pairs, $y_i$ is the spectrum parameter of the conversion-target speaker, $x_i$ is the spectrum parameter of the conversion-source speaker, and i is the number of a learning data pair. By the loop of steps S121 to S123, differences among all the learning spectrum parameter pairs are found, and in step S124, a translation distance b is found. The translation distance b becomes a conversion rule.

(3-2-2) Simple Linear Regression Analysis

Figure 13:
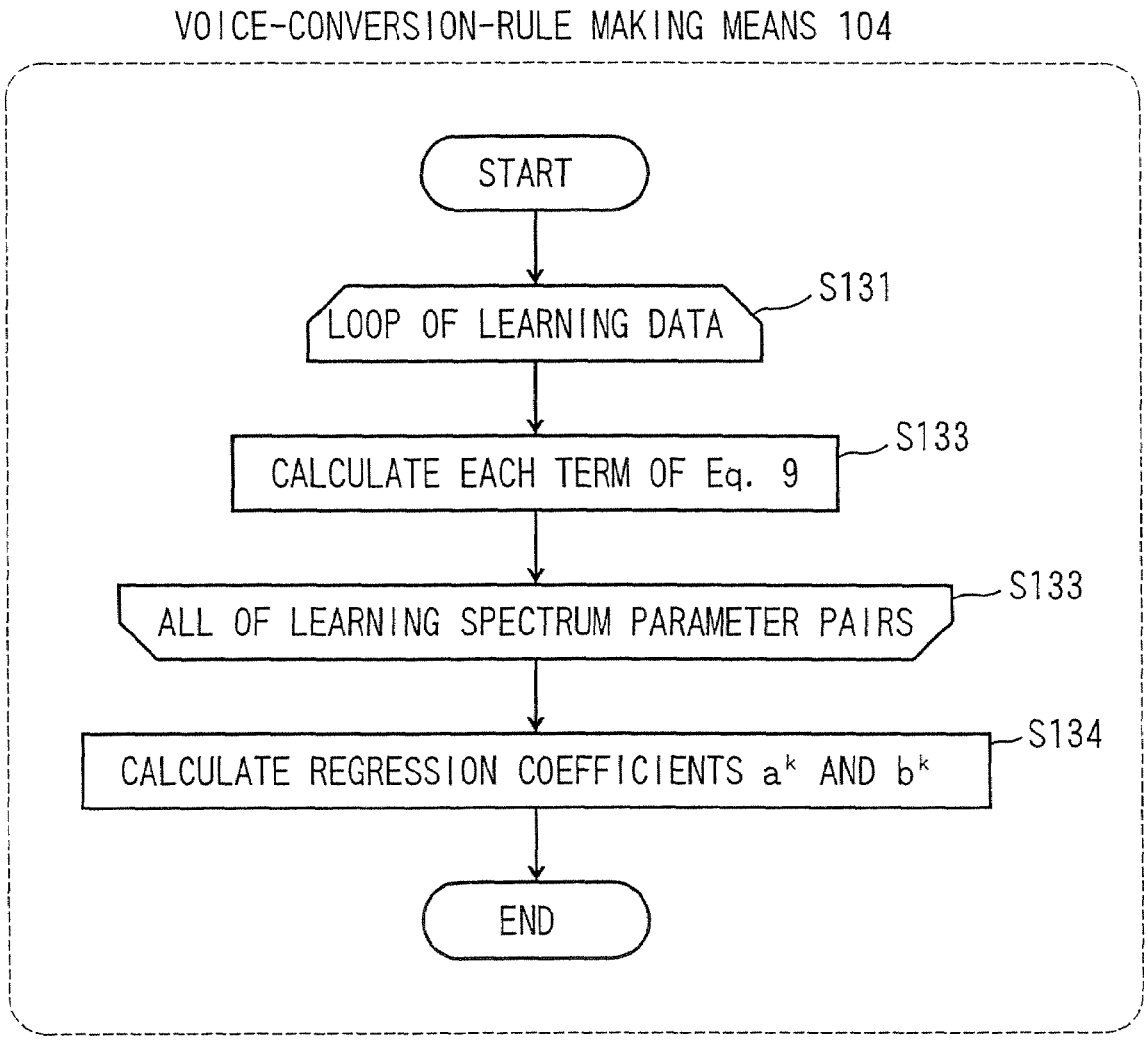
FIG. 13 is a flowchart for the process of the voice-conversion-rule making means.

FIG. 13 shows the process of the voice-conversion-rule making means 104 using simple linear regression analysis.

For simple linear regression analysis, regression analysis is executed for each order of the spectrum parameters. For the simple linear regression analysis, the voice conversion rule is expressed as the equation:

$$y'^k=a^kx^k+b^k \tag{8}$$

where $y'^k$ is a spectrum parameter after conversion, $x^k$ is a spectrum parameter of the conversion-source speaker, $a^k$ is a regression coefficient, $b^k$ is its offset, and k is the order of the spectrum parameters. The values $a^k$ and $b^k$ are found from the spectrum parameter pair or learning data by the equation:

$$a^k=\frac{N\sum_i x_i^k y_i^k-\sum_i x_i^k\sum_i y_i^k}{N\sum_i (x_i^k)^2-\left(\sum_i x_i^k\right)^2}, \tag{9}$$

$$b^k=\frac{N\sum_i (x_i^k)^2 y_i^k-\sum_i x_i^k y_i^k\sum_i x_i^k}{N\sum_i (x_i^k)^2-\left(\sum_i x_i^k\right)^2}$$

where N is the number of learning spectrum parameter pairs, $y_i^k$ is a spectrum parameter of the conversion-target speaker, $x_i^k$ is a spectrum parameter of the conversion-source speaker, and i is the number of a learning data pair.

By the loop of steps S131 to S133, the values of the terms of Eq. (9) necessary for regression analysis are found from all the learning spectrum parameter pairs, and in step S134, regression coefficients $a^k$ and $b^k$ are found. The regression coefficients $a^k$ and $b^k$ are used as conversion rules.

(3-2-3) Multiple Regression Analysis

Figure 14:
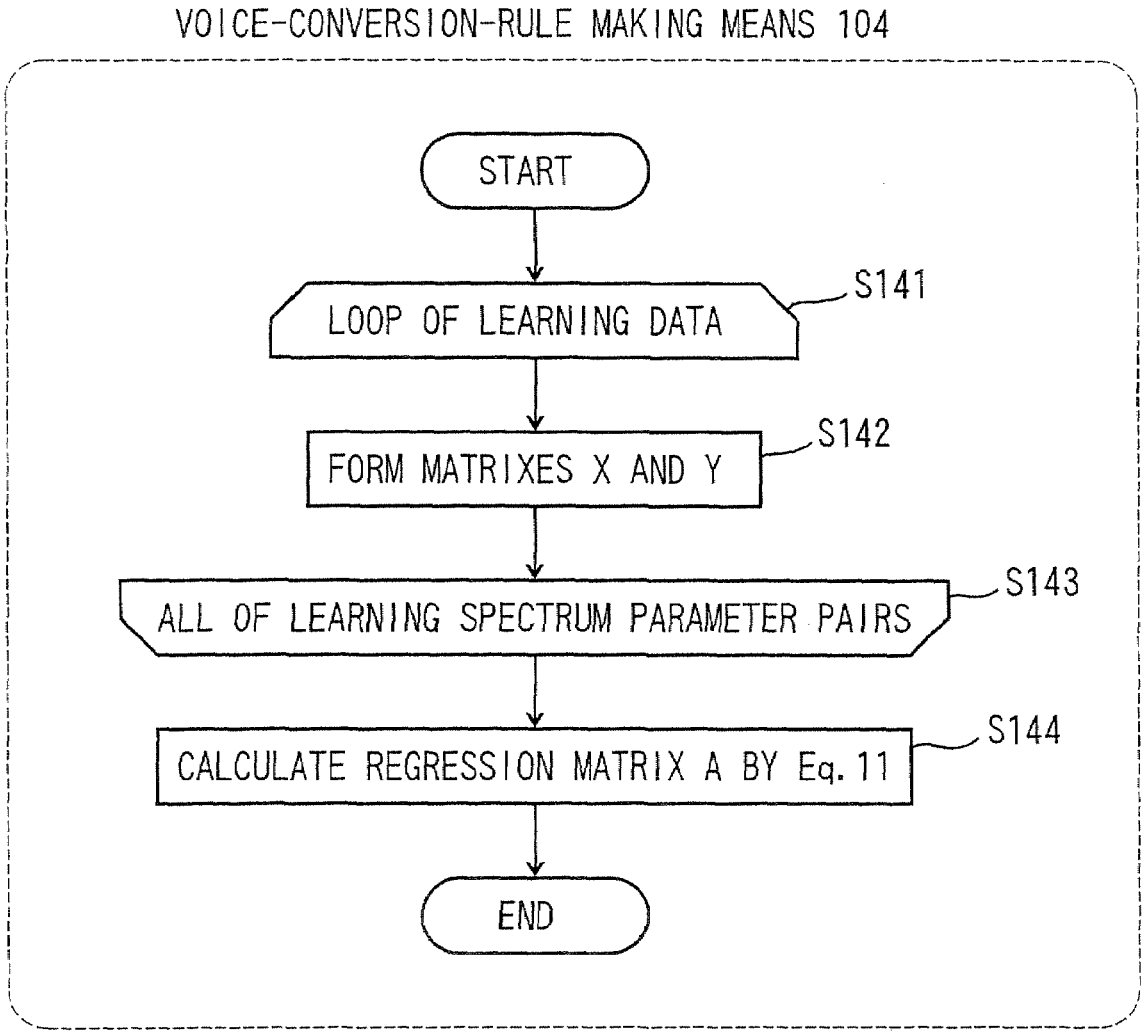
FIG. 14 is a flowchart for the process of the voice-conversion-rule making means.

FIG. 14 shows the process of the voice-conversion-rule making means 104 using multiple regression analysis.

For the multiple regression analysis, the voice conversion rule is expressed as the equation:

$$y'=Ax', x'=(x^T,1)^T \tag{10}$$

where y' is a spectrum parameter after conversion, x' is the sum of the spectrum parameter x of the conversion-source speaker and an offset term (1), and A is a regression matrix. A is found from the spectrum parameter pair or learning data. A can be given by the equation.

$$(X^TX)a^k=X^TY^k \tag{11}$$

where k is the order of the spectrum parameter, $a^k$ is the column of the matrix A, $Y^k$ is ($y1^k$ to $yN^k$)T, X is ($x'1^T$ to $x'N^T$), $x'i^T$ is given by adding an offset term to a conversion-source-speaker spectrum parameter $x^i$ into $(xi^T, 1)^T$, where $X^T$ is the transpose of the matrix X.

FIG. 14 shows the algorithm of the conversion rule learning. First, matrixes X and Y are generated from all the learning spectrum parameters through steps S141 to S143, and in step S144, a regression coefficient $a^k$ is found by solving Eq. (11), and the calculation is executed for all the orders to find the regression matrix A. The regression matrix A becomes a conversion rule.

(3-2-4) Vector Quantization

Figure 15:
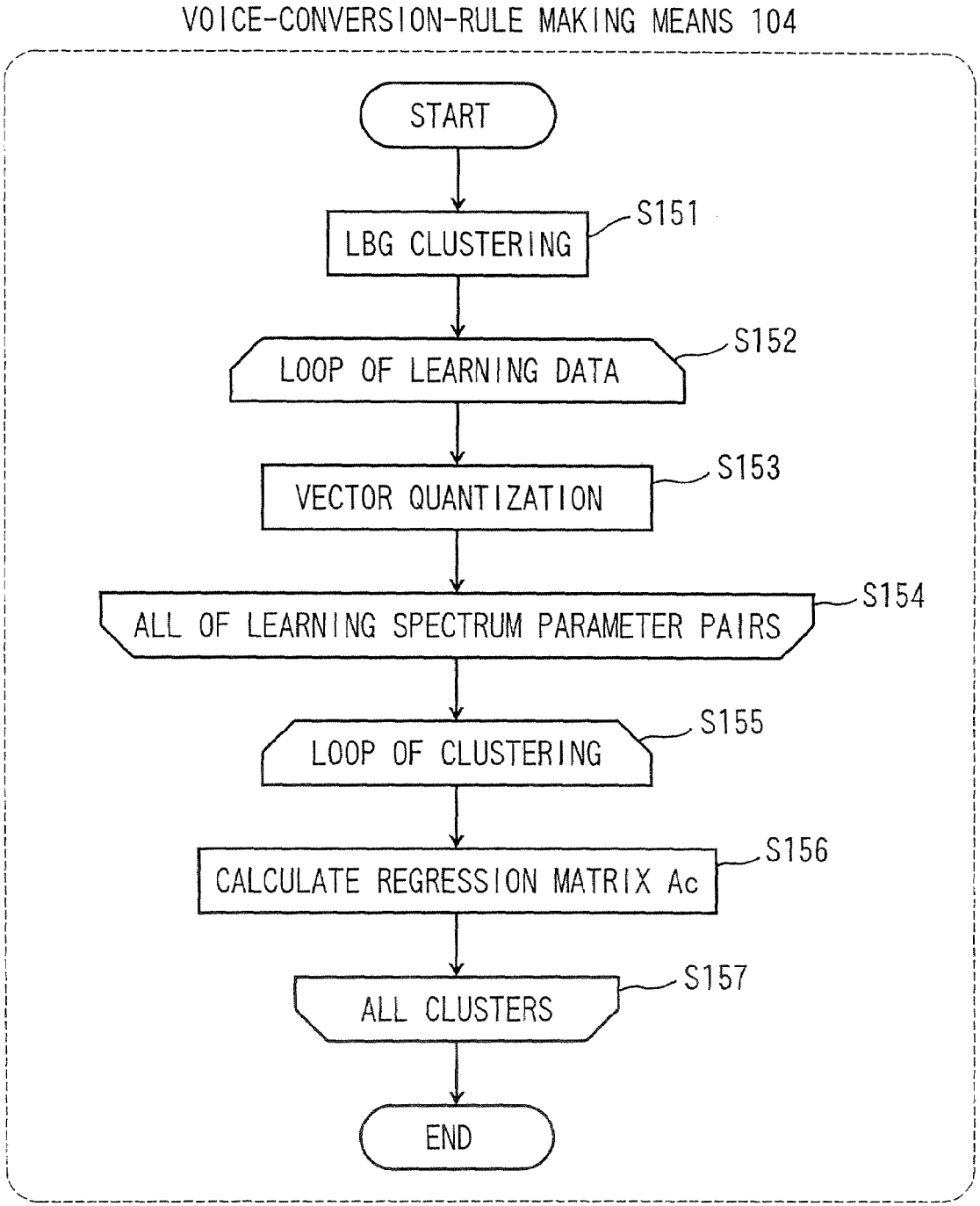
FIG. 15 is a flowchart for the process of the voice-conversion-rule making means.

FIG. 15 shows the process of the voice-conversion-rule making means 104 using vector quantization (VQ).

For the voice conversion rule by the VQ, the set of conversion-source-speaker spectrum parameters is clustered into C clusters by the LBG algorithm, and the conversion-source-speaker spectrum parameters of learning data pairs generated by the voice-conversion-rule-learning-data generating means 12 are allocated to the clusters by VQ, for each of which multiple regression analysis is performed. The voice conversion rule by the VQ is expressed as the equation:

$$y' = \sum_{c=1}^{C} sel^c(x) A^c x', \; x' = (x^T, 1)^T \tag{12}$$

where $A^c$ is the regression matrix of a cluster c, $sel^c(x)$ is a selection function that selects 1 when x belongs to the cluster c, otherwise selects 0. Eq. (12) indicates to select a regression matrix using the selection function and to convert the spectrum parameter for each cluster.

Figure 16:
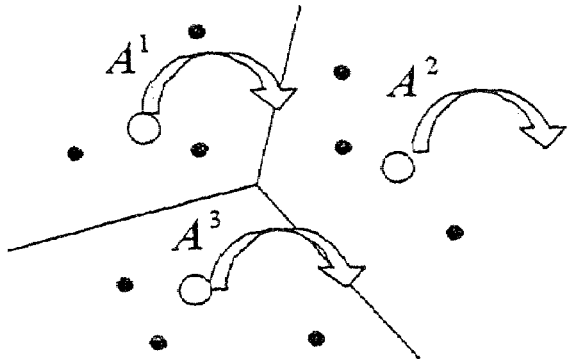
FIG. 16 is a conceptual diagram showing the operation of voice conversion by VQ of the voice-conversion-rule making means.

FIG. 16 shows the concept. The black dots in the figure indicate conversion-source-speaker spectrum parameters, while white dots each indicate a centroid found by the LBG algorithm.

The space of the conversion-source-speaker spectrum parameters is divided into clusters as indicated by the lines in the figure. A regression matrix $A^c$ is obtained in each cluster. For conversion, the input conversion-source-speaker spectrum parameters are associated with the clusters, and are converted by the regression matrix of each cluster.

In step S151, the voice-conversion-rule making means 104 clusters the conversion-source-speaker spectrum parameters to find the centroid of each cluster by the LBG algorithm until the number of the clusters reaches a predetermined number C. The clustering of learning data is performed using the spectrum parameter of the pitch-cycle waveform extracted from all speech units in the conversion-source-speaker speech-unit database 11. Only the spectrum parameters of conversion-source-speaker speech units selected by the voice-conversion-rule-learning-data generating means 12 may be clustered.

Then, in steps S152 to S154, the conversion-source-speaker spectrum parameters of the learning data pair generated by the voice-conversion-rule-learning-data generating means 12 are vector-quantized, which are each allocated to the clusters.

In steps S155 to S157, the regression matrix of each cluster is obtained using the pair of the conversion-source-speaker spectrum parameter and the conversion-target-speaker spectrum parameters. In regression-matrix calculating step S156, Eq. (11) is set up for each cluster, as in the process of steps S141 to 144 of FIG. 14, and the regression matrix $A^c$ is obtained by solving Eq. (11). For the voice conversion rule by the VQ, the centroid of each cluster obtained using the LBG algorithm and the regression matrix $A^c$ of each cluster become voice conversion rules.

(3-2-5) GMM Method

Figure 17:
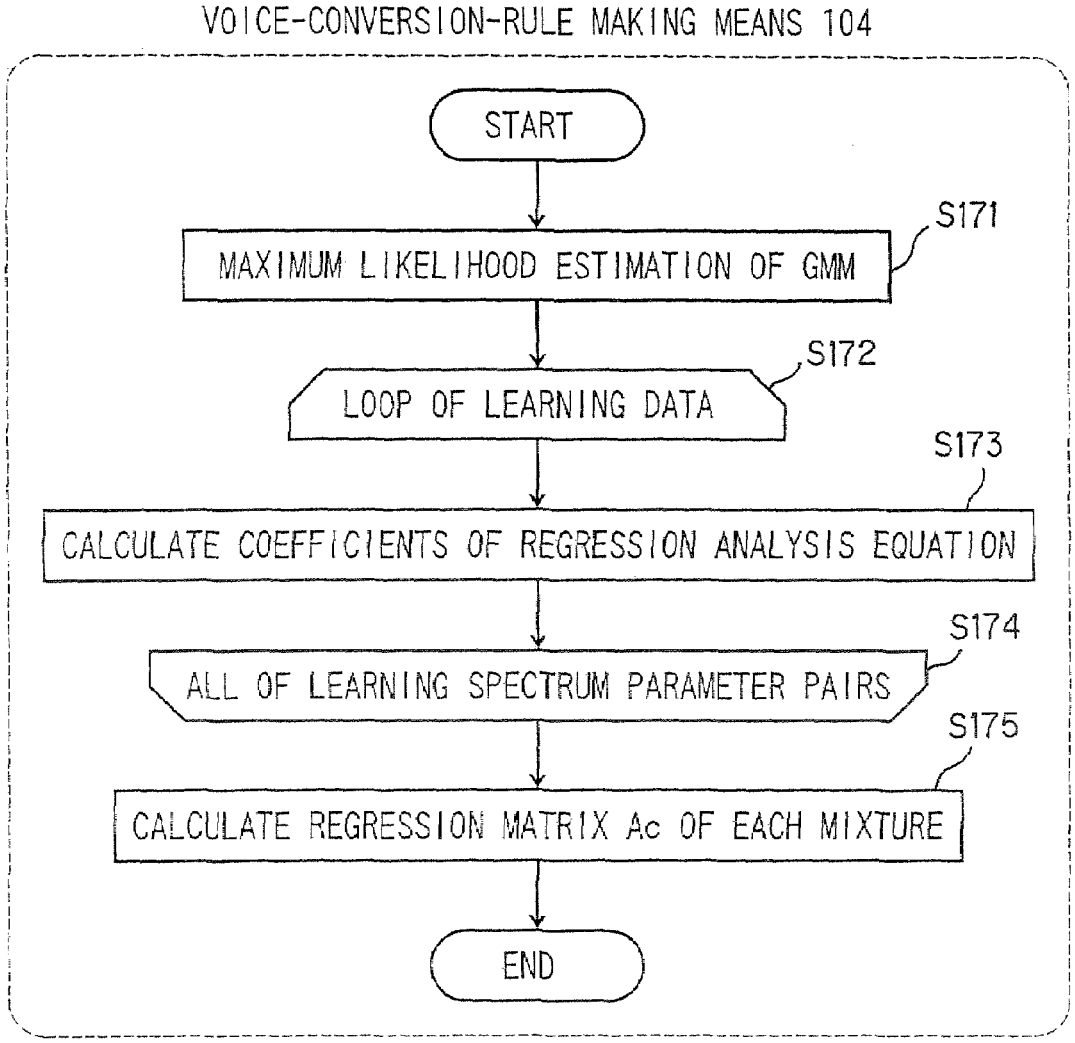
FIG. 17 is a flowchart for the process of the voice-conversion-rule making means.

Finally, FIG. 17 shows the process of the voice-conversion-rule making means 104 by the GMM, proposed in Nonpatent Document 1. The voice conversion by the GMM is executed in such a manner that conversion-source-speaker spectrum parameters are modeled by the GMM, and the input conversion-source-speaker spectrum parameters are weighted by posterior probability observed in the mixture of the GMM. GMM λ is expressed as the mixture of the Gaussian mixture model by the equation:

$$\begin{aligned} p(x|\vec{e}) &= \sum_{c=1}^{C} w_c p(x \mid \vec{e}_c) \\ &= \sum_{c=1}^{C} w_c N(x \mid \mu_c, \Sigma_c) \end{aligned} \tag{13}$$

where p is likelihood, c is mixture, $w_c$ is mixture weight, $p(x|\lambda_c)=N(x|\mu_c, \Sigma c)$ is the likelihood of the Gaussian distribution of a mean $\mu_c$ and dispersion Σc of mixture c. where the voice conversion rule by the GMM is expressed as the equation:

$$y' = \sum_{c=1}^{C} p(m_c|x) A^c x', \; x' = (x^T, 1)^T \tag{14}$$

where $p(m_c|x)$ is the probability that x is observed in mixture $m_c$.

$$p(m_c|x) = \frac{w_c p(x \mid \vec{e}_c)}{p(x \mid \vec{e})} \tag{15}$$

Figure 18:
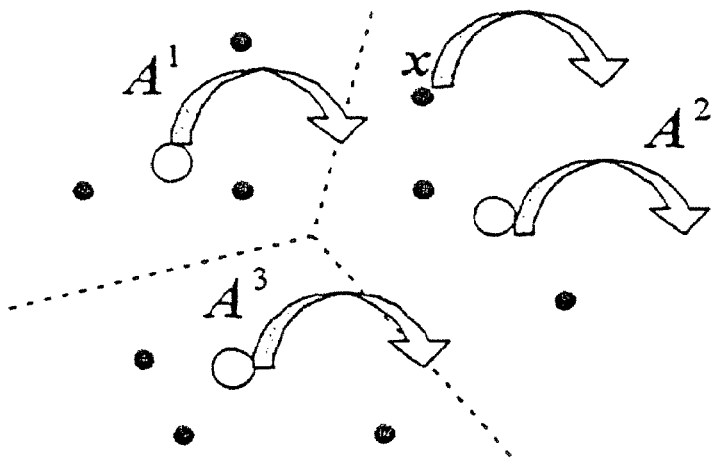
FIG. 18 is a conceptual diagram showing the operation of voice conversion by GMM of the voice-conversion-rule making means.

The voice conversion by the GMM has the characteristic that continuously changing regression matrix in the mixture is obtained. FIG. 18 shows the concept. The black dots in the figure indicate conversion-source-speaker spectrum parameters, while white dots each indicate the mean of the mixture obtained by the maximum likelihood estimation of the GMM.

In the voice conversion by the GMM, the clusters in the voice conversion by the VQ correspond to the mixtures of the GMM, and each mixture is expressed as Gaussian distribution, and has parameters: mean μc, dispersion Σc, mixture weight $w_c$. Spectrum parameter x is applied to weight the regression matrix of each mixture according to the posterior probability of Eq. (14), where $A^c$ is the regression matrix of each mixture.

As shown in the equation, when the probability that the conversion-source-speaker spectrum parameter x is generated in mixture $m_1$ is 0.3; when the probability that the spectrum parameter x is generated in mixture $m_2$ is 0.6; and when the probability that the spectrum parameter x is generated in mixture $m_3$ is 0.1, a conversion-target-speaker spectrum parameter y is given by weighted sum of the spectrum parameters converted using the regression matrix of each cluster.

For the GMM, in step S171, the voice-conversion-rule making means 104 estimates the GMM by maximum likelihood estimation. For the initial value of the GMM, the cluster produced by the LBG algorithm is given, and the maximum likelihood parameters of the GMM are estimated by the EM algorithm. Then, in steps S172 to S174, the coefficients of the equation for obtaining the regression matrix are calculated. The data weighted by Eq. (14) is subjected to the same process as shown in FIG. 14, whereby the coefficients of the equation are found, as described in Patent Document 1. In step S175, the regression matrix $A^c$ of each mixture is determined. With the voice conversion by the GMM, the model parameter $\lambda$ of the GMM and the regression matrix $A^c$ of each mixture become voice conversion rules.

Thus, the voice conversion rules by translation, simple linear regression analysis, multiple regression analysis, and vector quantization (VQ), and voice conversion rule by the Gaussian mixture model (GMM) are obtained.

(4) Advantages

According to the embodiment, speech-unit and attribute information can be extracted from the speech data of a conversion-target speaker, and speech units can be selected from a conversion-source-speaker speech-unit database based on the mismatch of the attribute information, whereby voice conversion rules can be learned using the pair of the conversion-target speaker and the conversion-source speaker as learning data.

According to the embodiment, a voice-conversion-rule making apparatus can be provided which can make voice conversion rules with the speech of any sentence of the conversion-target speaker, and which can learn conversion rules reflecting the information contained in the mass conversion-source-speaker speech-unit database.

(5) Modifications

According to the embodiment, a speech unit or speech units of a plurality of conversion-source speakers whose cost are the minimum are selected using the mismatch of the attribute information of the conversion-target speaker and that of the conversion-source speaker as the cost function shown in Eq. (5).

Alternatively, the attribute information of the conversion-target speaker is converted so as to be close to the attribute information of the conversion-source speaker, and the cost in Eq. (5) is found from the mismatch between the converted conversion-target-speaker attribute information and the conversion-source-speaker attribute information, with which a speech unit of the conversion-source speaker may be selected.

(5-1) Process of Attribute-Information Generating Means 22

Figure 19:
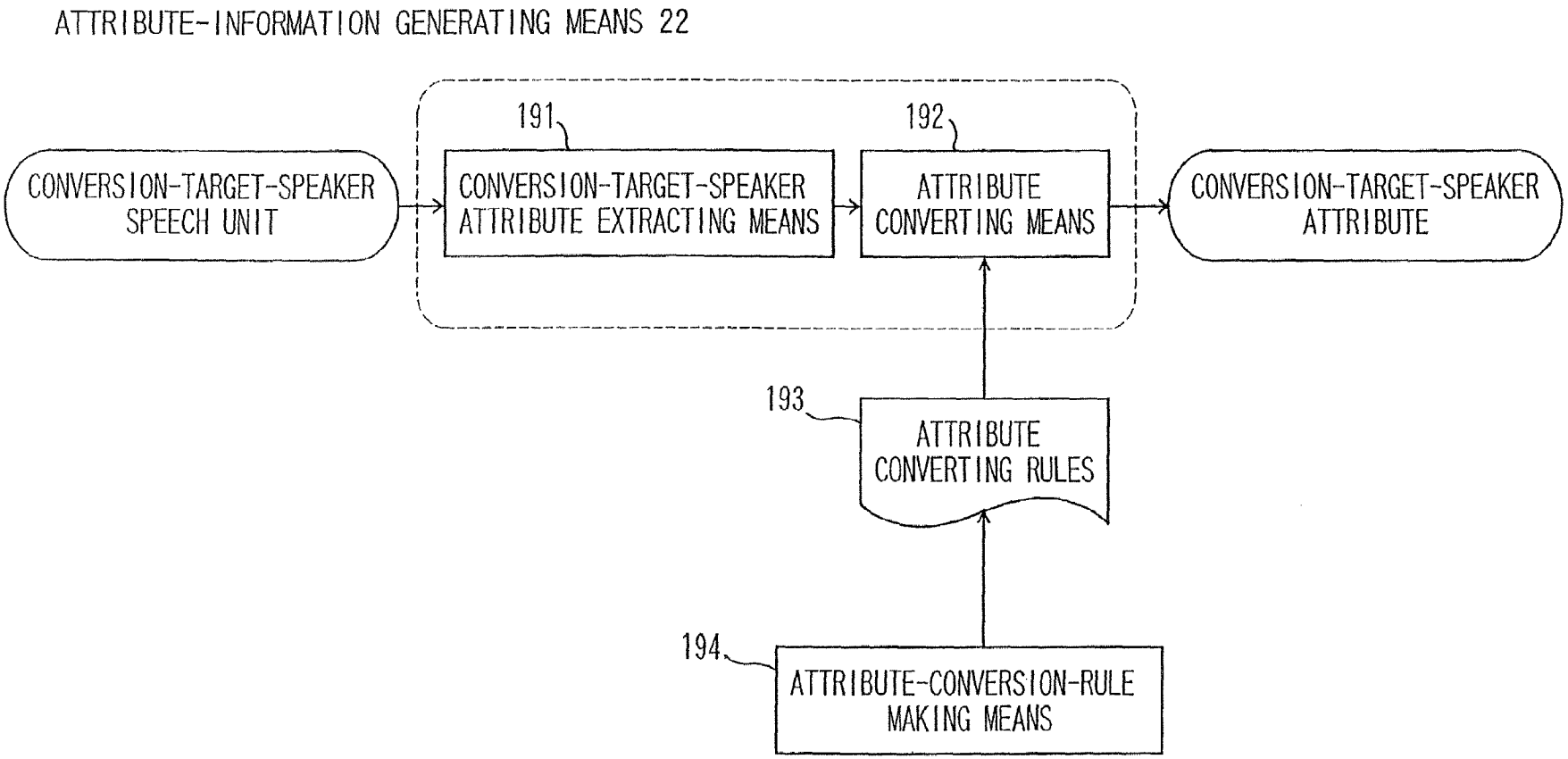
FIG. 19 is a block diagram showing the structure of the attribute-information generating means.

The process of the attribute-information generating means 22 for this case will be shown in FIG. 19.

The attribute-information generating means 22 extracts the attributes of the conversion-target speaker from the speech unit of the conversion-target speaker by a conversion-target-speaker attribute extracting means 191.

The conversion-target-speaker attribute extracting means 191 extracts the information shown in FIG. 5, such as the fundamental frequency of the conversion-target speaker, phoneme duration information, concatenation boundary cepstrum, and phoneme environment information.

An attribute converting means 192 converts the attributes of the conversion-target speaker so as to be close to the attributes of the conversion-source speaker to generate conversion-target-speaker attribute information to be input to the conversion-source-speaker speech-unit selection means 23. The conversion of the attributes is performed using attribute conversion rules 193 that are made in advance by an attribute-conversion-rule making means 194.

(5-2) Conversion of Fundamental Frequency and Phoneme Duration

An example of conversion of the fundamental frequency and phone duration of the attribute information shown in FIG. 5 will be described.

Figure 20:
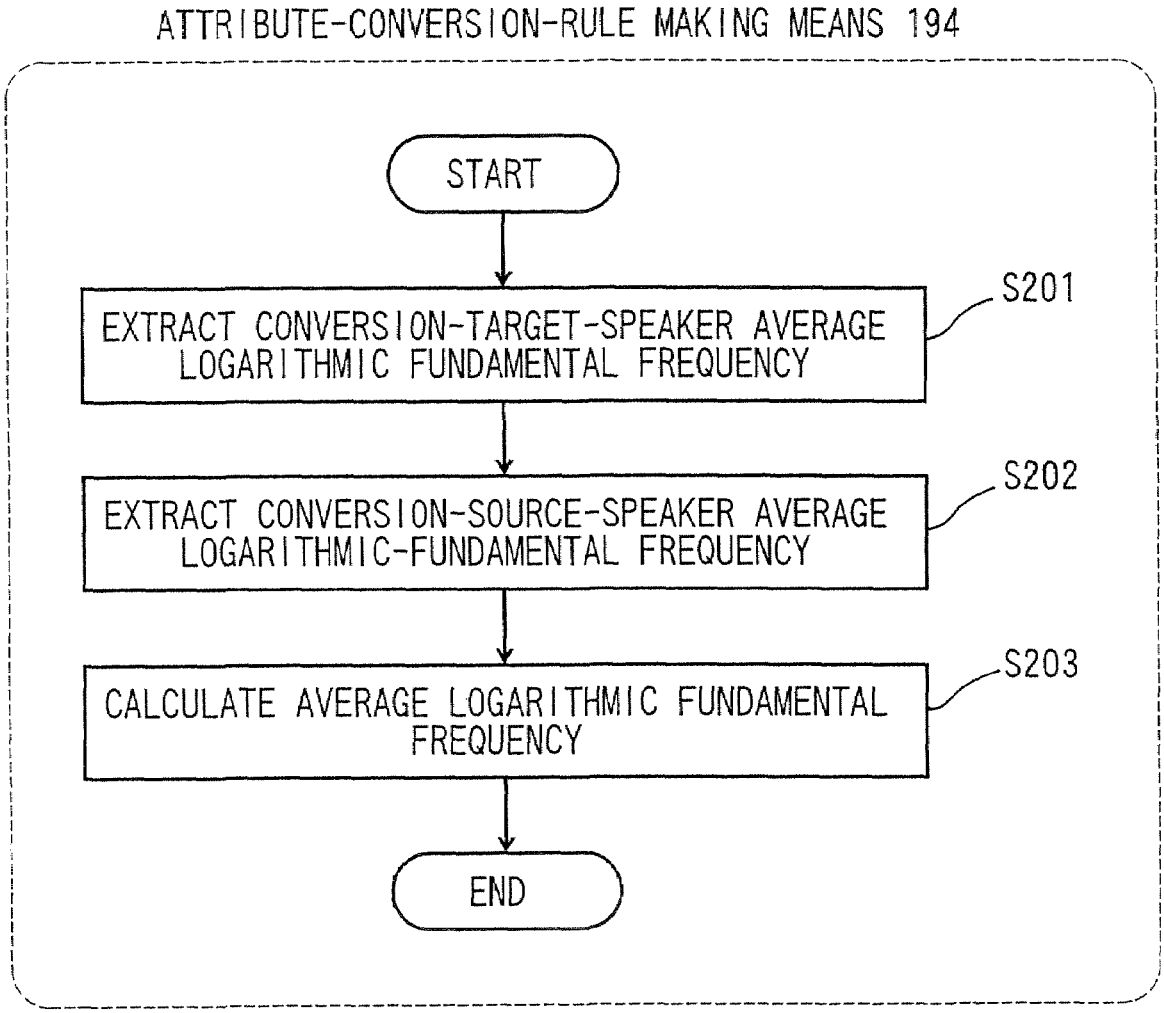
FIG. 20 is a flowchart for the process of an attribute-conversion-rule making means.
Figure 21:
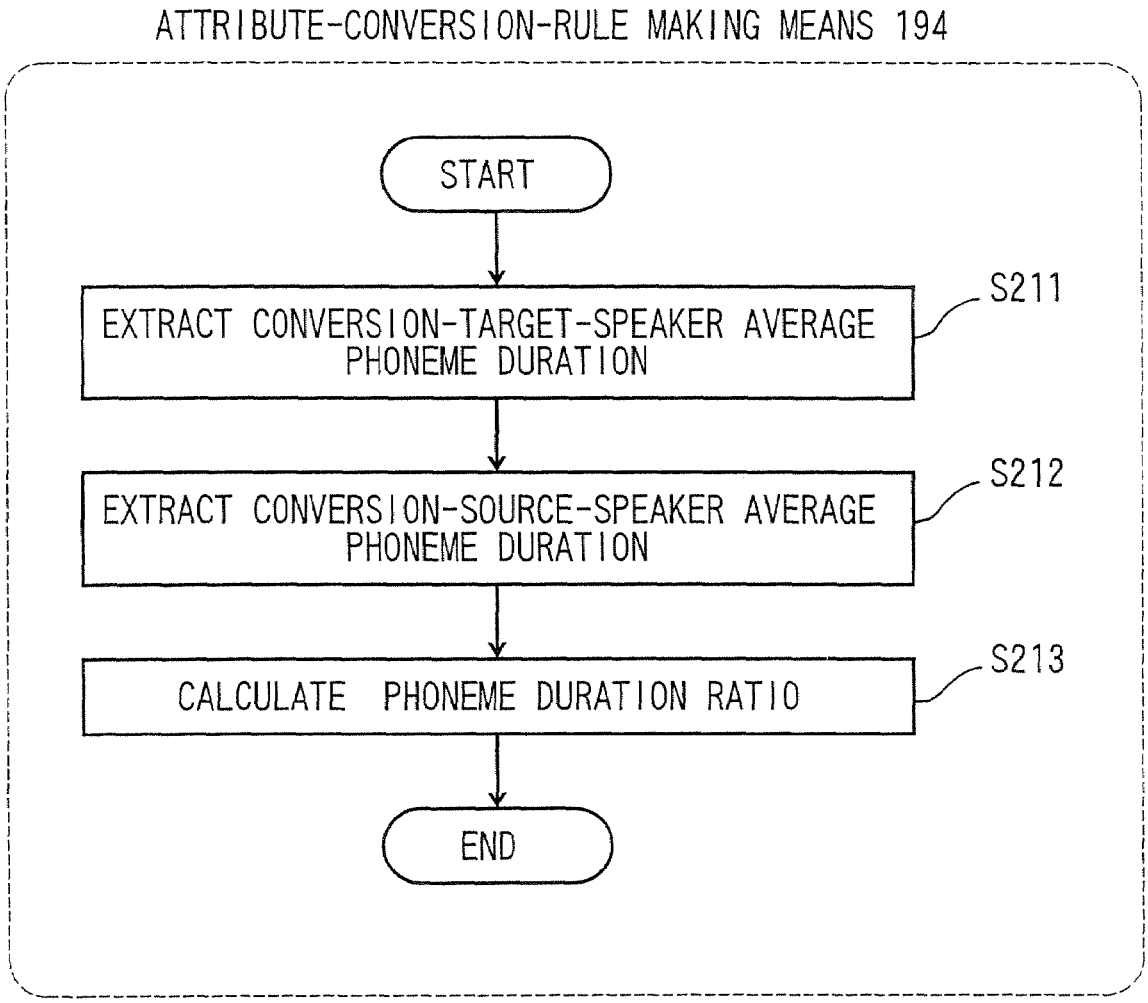
FIG. 21 is a flowchart for the process of the attribute-conversion-rule making means.
Figure 22:
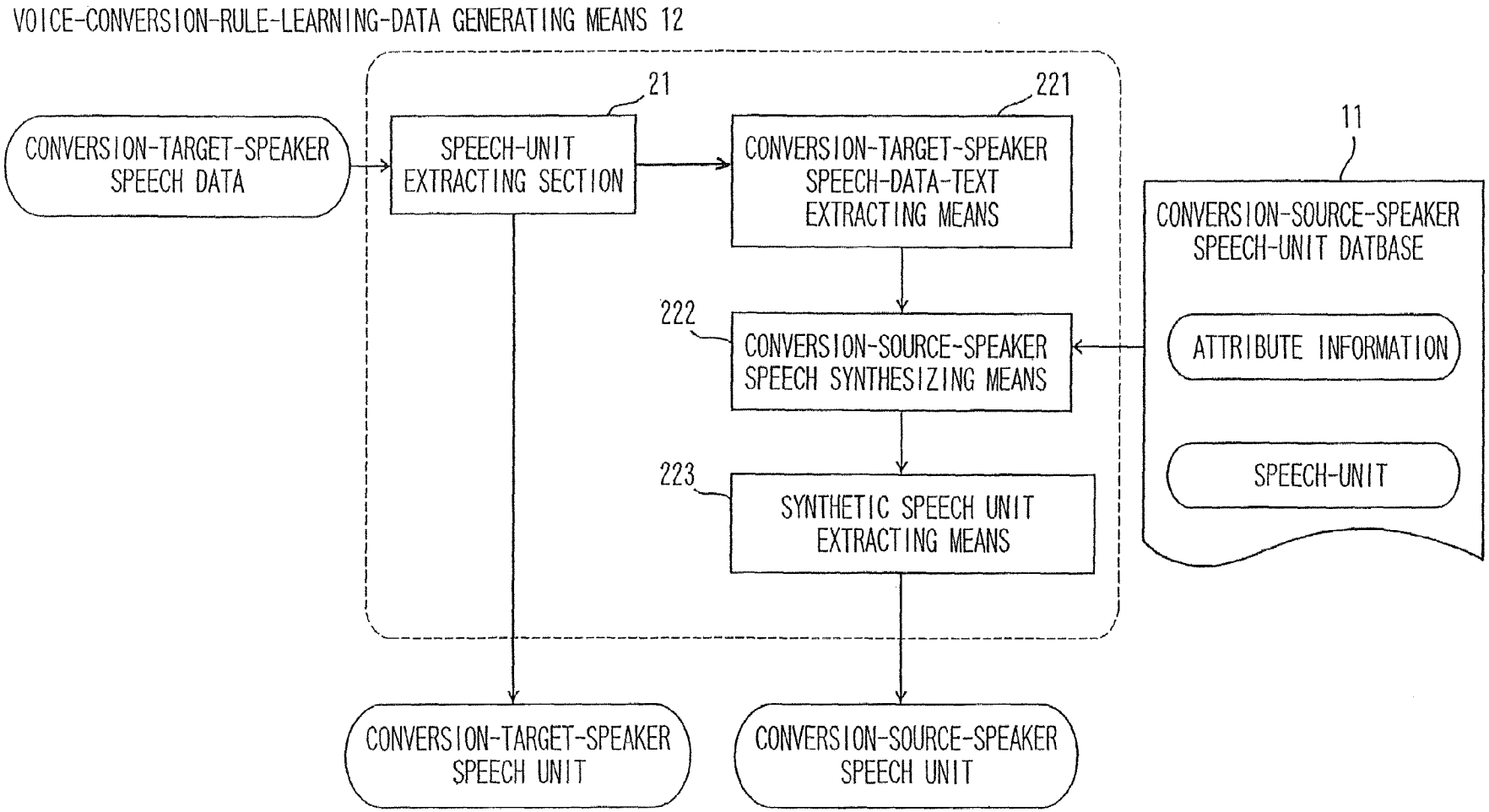
FIG. 22 is a block diagram showing the structure of a speech synthesizing means.

In this case, the attribute-conversion-rule making means 194 prepares rules to bring the fundamental frequency of the conversion-target speaker to that of the conversion-source speaker and rules to bring the phoneme duration of the conversion-target speaker to that of the conversion-source speaker. FIGS. 20 and 21 show the flowchart for the process.

In conversion-target-speaker average-logarithmic-fundamental-frequency extracting step S201, the average of the logarithmic fundamental frequencies extracted from the speech data of the conversion-target speaker is found.

In conversion-source-speaker average-logarithmic-fundamental-frequency extracting step S202, the average of the logarithmic fundamental frequencies extracted from the speech data of the conversion-source speaker is found.

In average-logarithmic-fundamental-frequency difference calculating step S203, the difference between the average logarithmic fundamental frequency of the conversion-source speaker and that of the conversion-target speaker is calculated to be the attribute conversion rule 193.

Similarly, in conversion-target-speaker average-phoneme-duration extracting step S211 of FIG. 21, the average of the phoneme duration of the conversion-target speaker is extracted.

In conversion-source-speaker average-phoneme-duration extracting step S212, the average of the phoneme duration of the conversion-source speaker is extracted.

In phoneme-duration-ratio calculating step S213, the ratio of the average phoneme duration of the conversion-source speaker to that of the conversion-target speaker is calculated to be the attribute conversion rule 193.

The attribute conversion rules 193 may include a rule to correct the range of the average logarithmic fundamental frequency as well as the average logarithmic fundamental-frequency difference and the average phoneme duration ratio. Furthermore, the attribute conversion rules 193 may not be common to all data but the attributes may be clustered by, for example, making rules on the phoneme or accent type basis and the attribute conversion rule can be obtained in each cluster. Thus, the attribute-conversion-rule making means 194 makes the attribute conversion rules 193.

The attribute-information generating means 22 obtains the attributes shown in FIG. 5 from the conversion-target-speaker speech unit, and converts the fundamental frequency and the phoneme duration in the attributes according to the conversion rules in the attribute conversion rules 193. For the fundamental frequency, the attribute-information generating means 22 converts the fundamental frequency to a logarithmic fundamental frequency, then converts it so as to be close to the fundamental frequency of the conversion-source speaker by adding a average logarithmic-fundamental-frequency difference to the logarithmic fundamental frequency, and then returns the converted logarithmic fundamental frequency to the fundamental frequency, thereby making a fundamental frequency attribute of the conversion-target speaker at the selection of the speech unit.

For the phoneme duration, the attribute-information generating means 22 converts the phoneme duration so as to be close to that of the conversion-source speaker by multiplying a average phoneme duration ratio, thereby generating a conversion-target-speaker phoneme duration attribute at the selection of the speech unit.

In the case where voice conversion rules are learned for speakers whose average fundamental frequencies are significantly different, as in the case where a male voice is converted to a female voice, when speech units are selected from a speech unit database of a male conversion-source speaker using the fundamental frequency of a female conversion-target speaker, only speech units of the highest fundamental frequency are selected from the male speech unit database. However, this arrangement can prevent such bias of speech units selected.

Also, in the case where voice conversion rules to convert the voice of a fast speaking speed to that of a slow speaking speed are made, only speech units with the longest phoneme duration are selected from the speech units of the conversion-source speaker. This arrangement can also prevent such bias of selection of the speech units.

Accordingly, even if the characteristics of the conversion-target speaker and the conversion-source speaker are different, speech conversion rules that reflect the characteristics of the speech units contained in the speech unit database of the conversion-source speaker can be made.

SECOND EMBODIMENT

A voice conversion apparatus according to a second embodiment of the invention will be described with reference to FIGS. 23 to 26.

The voice conversion apparatus applies the voice conversion rules made by the voice-conversion-rule making apparatus according to the first embodiment to any speech data of a conversion-source speaker to convert the voice quality in the conversion-source-speaker speech data to the voice quality of a conversion-target speaker.

(1) Structure of Voice Conversion Apparatus

Figure 23:
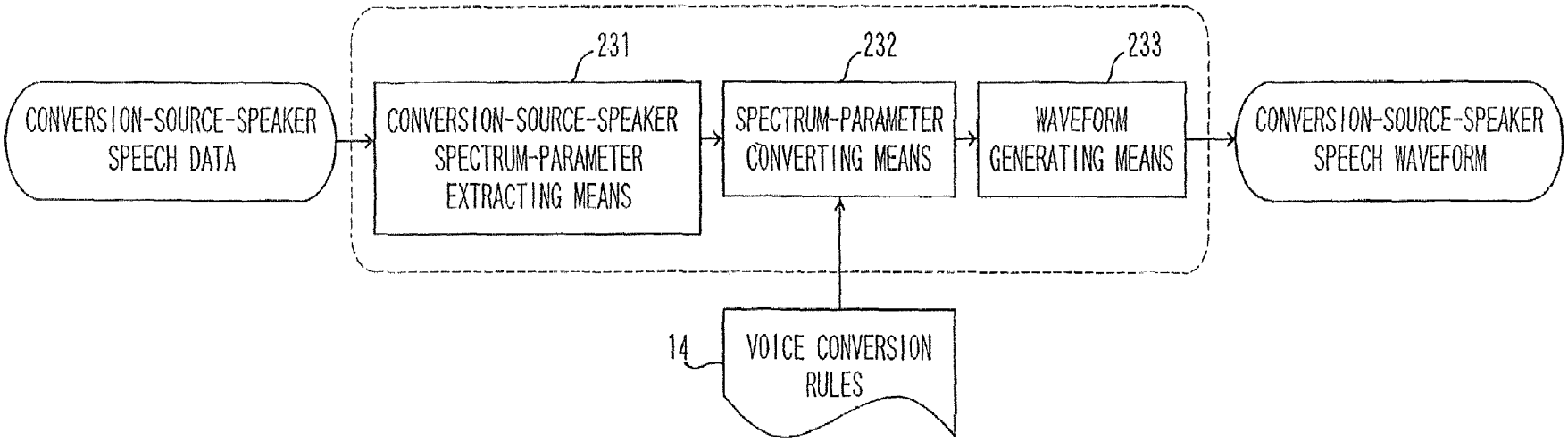
FIG. 23 is a block diagram showing the structure of a voice conversion apparatus according to a second embodiment of the invention.

FIG. 23 is a block diagram showing the voice conversion apparatus according to the second embodiment.

The voice conversion apparatus first extracts spectrum parameters from the speech data of a conversion-source speaker with a conversion-source-speaker spectrum-parameter extracting means 231.

A spectrum-parameter converting means 232 converts the extracted spectrum parameters according to the voice conversion rules 14 made by the voice-conversion-rule making apparatus according to the first embodiment.

A waveform generating means 233 generates a speech waveform from the converted spectrum parameters. Thus a conversion-target speaker speech waveform converted from the conversion-source-speaker speech data can be generated.

(2) Conversion-Source-Speaker Spectrum-Parameter Extracting Means 231

The conversion-source-speaker spectrum-parameter extracting means 231 places pitch marks on the conversion-source-speaker speech data, cuts out pitch-cycle waveforms with each pitch mark as the center, and conducts a spectrum analysis of the cut-out pitch-cycle waveforms. For the pitch marking and the spectrum analysis, the same method as that of the conversion-source-speaker spectrum-parameter extracting section 102 according to the first embodiment is used. Thus, the spectrum parameters extracted by the conversion-source-speaker spectrum-parameter extracting means 102 of FIG. 11 are obtained for the pitch-cycle waveforms of the conversion-source-speaker speech data.

(3) Spectrum-Parameter Converting Means 232

The spectrum-parameter converting means 232 converts the spectrum parameters according to the voice conversion rules in the voice conversion rules 14 made by the voice-conversion-rule learning means 13.

(3-1) Translation

For translation, the voice conversion rule is expressed as Eq. (6), where x is the spectrum parameter of the conversion-source speaker, y' is a spectrum parameter after conversion, and b is a translation distance.

(3-2) Simple Linear Regression Analysis

With simple linear regression analysis, the voice conversion rule is expressed as Eq. (8), where $x^k$ is the k-order spectrum parameter of the conversion-source speaker, $y'^k$ is the k-order spectrum parameter after conversion, $a^k$ is a regression coefficient for the k-order spectrum parameter, and $b^k$ is the bias of the k-order spectrum parameter.

(3-3) Multiple Regression Analysis

For multiple regression analysis, the voice conversion rule is expressed as Eq. (10), where x' is the spectrum parameter of the conversion-source speaker, y' is a spectrum parameter after conversion, and A is a regression matrix.

(3-4) Vector Quantization Method

Figure 24:
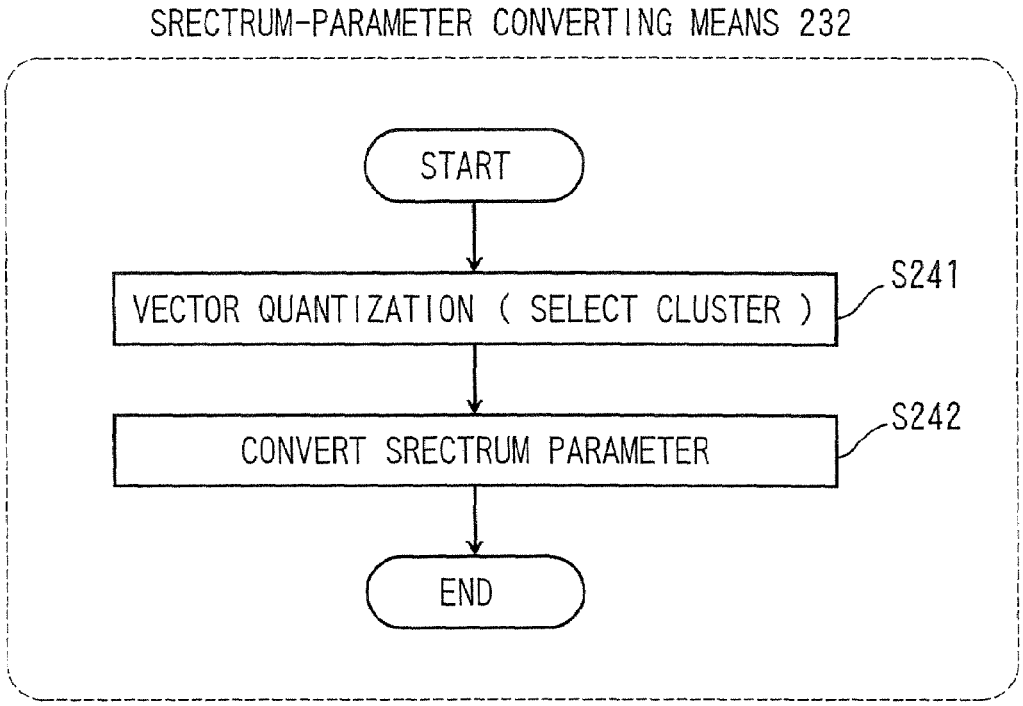
FIG. 24 is a flowchart for the process of a spectrum-parameter converting means.

For the VQ method, the spectrum-parameter converting means 232 converts the spectrum parameters of the conversion-source speaker by the process of FIG. 24.

Referring to FIG. 24, in step S241, the distance between the centroid of each cluster obtained using the LBG algorithm by the voice-conversion-rule learning means 13 and the input spectrum parameter, from which a cluster in which the distance is the minimum is selected (vector quantization).

In step S242, the spectrum parameter is converted by Eq. (12), where x' is the spectrum parameter of the conversion-source speakers y' is a spectrum parameter after conversion, and $sel^c(x)$ is a selection function that selects 1 when x belongs to the cluster c, otherwise selects 0.

(3-5) GMM Method

Figure 25:
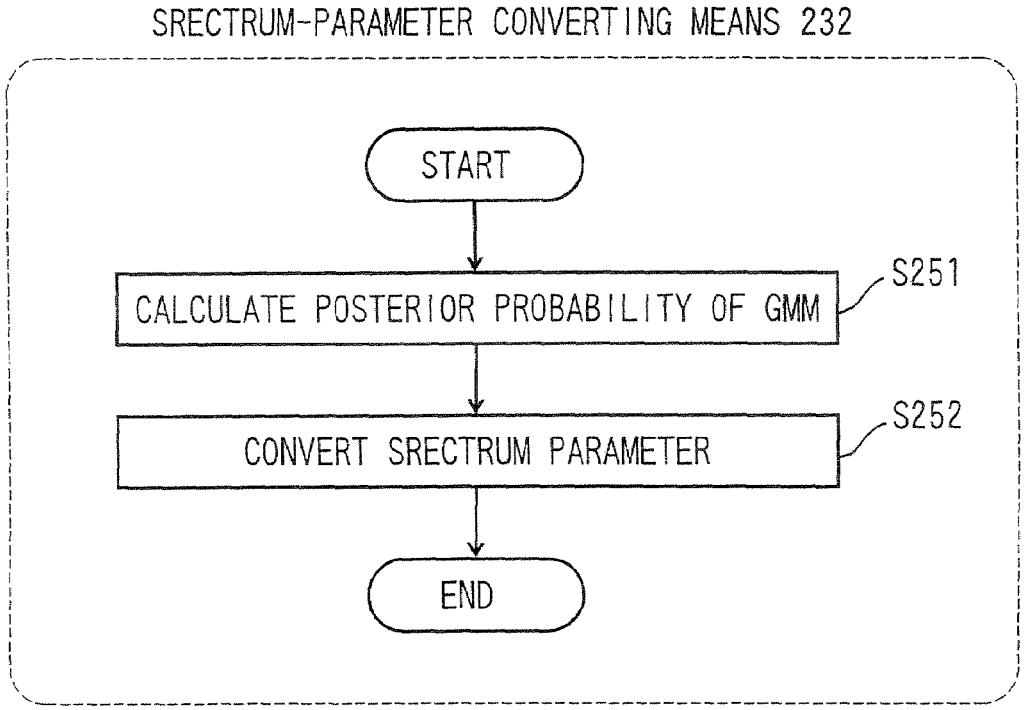
FIG. 25 is a flowchart for the process of the spectrum-parameter converting means.

FIG. 25 shows the process of the GMM method.

Referring to FIG. 25, in step S251, Eq. (15) of posterior probability is calculated in which spectrum parameters are generated in each mixture of the GMM obtained by the maximum likelihood estimation of the voice-conversion-rule learning means 13.

Then, in step S252, the spectrum parameters are converted by Eq. (14), with the posterior probability of each mixture as a weight. In Eq. (14), p(mc|x) is the probability that x is observed in mixture $m_c$, x' is the spectrum parameter of the conversion-source speaker, y' is a spectrum parameter after conversion, and $A^c$ is the regression matrix of mixture c.

Thus, the spectrum-parameter converting means 232 converts the spectrum parameters of the conversion-source speaker according to the respective voice conversion rules (4) Waveform Generating Means 233

The waveform generating means 233 generates a waveform from the converted spectrum parameters.

Specifically, the waveform generating means 233 gives an appropriate phase to the spectrum of the converted spectrum parameter, generates pitch-cycle waveforms by inverse Fourier transformation, and overlap-adds the pitch-cycle waveforms on pitch marks, thereby generating a waveform.

The pitch marks for generating a waveform may be ones that are changed from the pitch marks of the conversion-source speaker so as to be close to the phoneme of the target speaker. In this case, the conversion rules of the fundamental frequency and the phoneme duration, generated by the attribute-conversion-rule making means 194 shown in FIGS. 20 and 21, are converted for the fundamental frequency and phoneme duration extracted from the conversion-source speaker, from which pitch marks are formed.

Thus the phoneme information can be brought close to that of the target speaker.

While the pitch-cycle waveforms are generated by inverse Fourier transformation, the pitch-cycle waveforms may be regenerated by filtering with appropriate voice-source information. For the LPC coefficient, pitch-cycle waveforms can be generated using an all-pole filter; for mel-cepstrum, pitch-cycle waveforms can be generated with voice-source information through a MLSA filter and a spectrum envelope parameter.

(5) Speech Data

Figure 26:
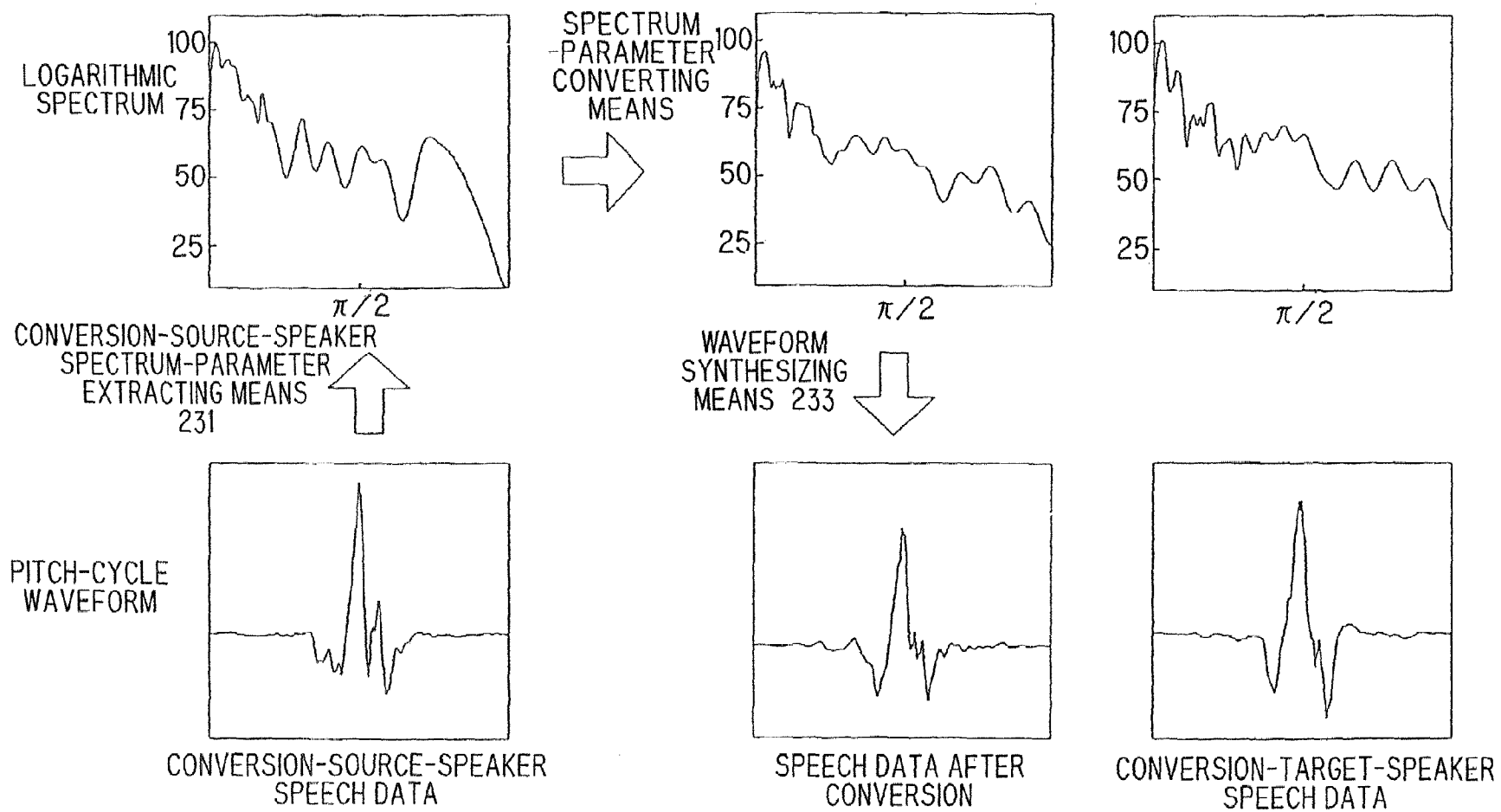
FIG. 26 is a diagram showing an example of the operation of the voice conversion apparatus according to the second embodiment.

FIG. 26 shows examples of speech data converted by the voice conversion apparatus.

FIG. 26 shows the logarithmic spectrums and pitch-cycle waveforms extracted from the speech data of a conversion-source speaker, speech data after conversion, and the speech data of a conversion-target speaker, respectively, from the left.

The conversion-source-speaker spectrum-parameter extracting means 231 extracts a spectrum envelope parameter from the pitch-cycle waveforms extracted from the conversion-source speaker speech data. The spectrum-parameter converting means 232 converts the extracted spectrum envelope parameter according to speech conversion rules. The waveform generating means 233 then generates a pitch-cycle waveform after conversion from the converted spectrum envelope parameter. Comparison with the pitch-cycle waveform and the spectrum envelope extracted from the conversion-target-speaker speech data shows that the pitch-cycle waveform after conversion is close to that extracted from the conversion-target-speaker speech data.

(6) Advantages

As has been described, the arrangement of the second embodiment enables the input conversion-source-speaker speech data to be converted to the voice quality of the conversion-target speaker using the voice conversion rules made by the voice-conversion-rule making apparatus of the first embodiment.

According to the second embodiment, the voice conversion rules according to any sentence of a conversion-target speaker or voice conversion rules that reflect the information in the mass conversion-source-speaker speech-unit database can be applied to conversion-source-speaker speech data, so that high-quality voice conversion can be achieved.

THIRD EMBODIMENT

A text-to-speech synthesizer according to a third embodiment of the invention will be described with reference to FIGS. 27 to 33.

The text-to-speech synthesizer generates synthetic speech having the same voice quality as a conversion-target speaker for the input of any sentence by applying the voice conversion rules made by the voice-conversion-rule making apparatus according to the first embodiment.

(1) Structure of Text-to-Speech Synthesizer

Figure 27:
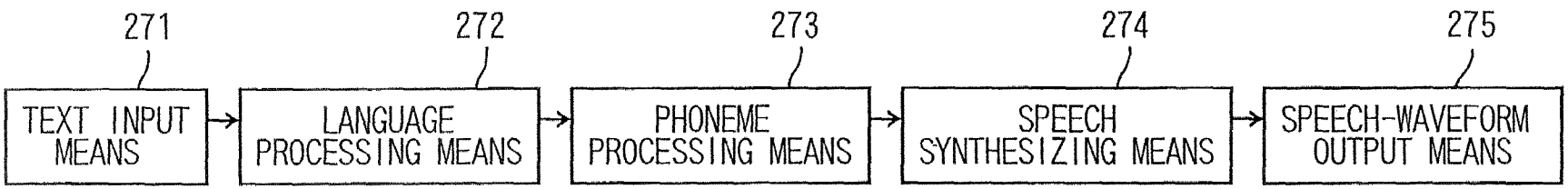
FIG. 27 is a block diagram showing the structure of a speech synthesizer according to a third embodiment of the invention.

FIG. 27 is a block diagram showing the text-to-speech synthesizer according to the third embodiment.

The text-to-speech synthesizer includes a text input means 271, a language processing means 272, a prosody processing means 273, a speech synthesizing means 274, and a speech-waveform output means 275.

(2) Language Processing Means 272

The language processing means 272 analyzes the morpheme and structure of a text inputted from the text input means 271, and sends the results to the prosody processing means 273.

(3) Prosody Processing Means 273

The phoneme processing means 273 processes accent and intonation based on the language analysis to generate phoneme sequence (phonemic symbol string) and prosodic information, and sends them to the speech synthesizing means 274.

(4) Speech Synthesizing Means 274

The speech synthesizing means 274 generates speech waveform from the phoneme sequence and prosodic information. The generated speech waveform is output by the speech-waveform output means 275.

(4-2) Structure of Speech Synthesizing Means 274

Figure 28:
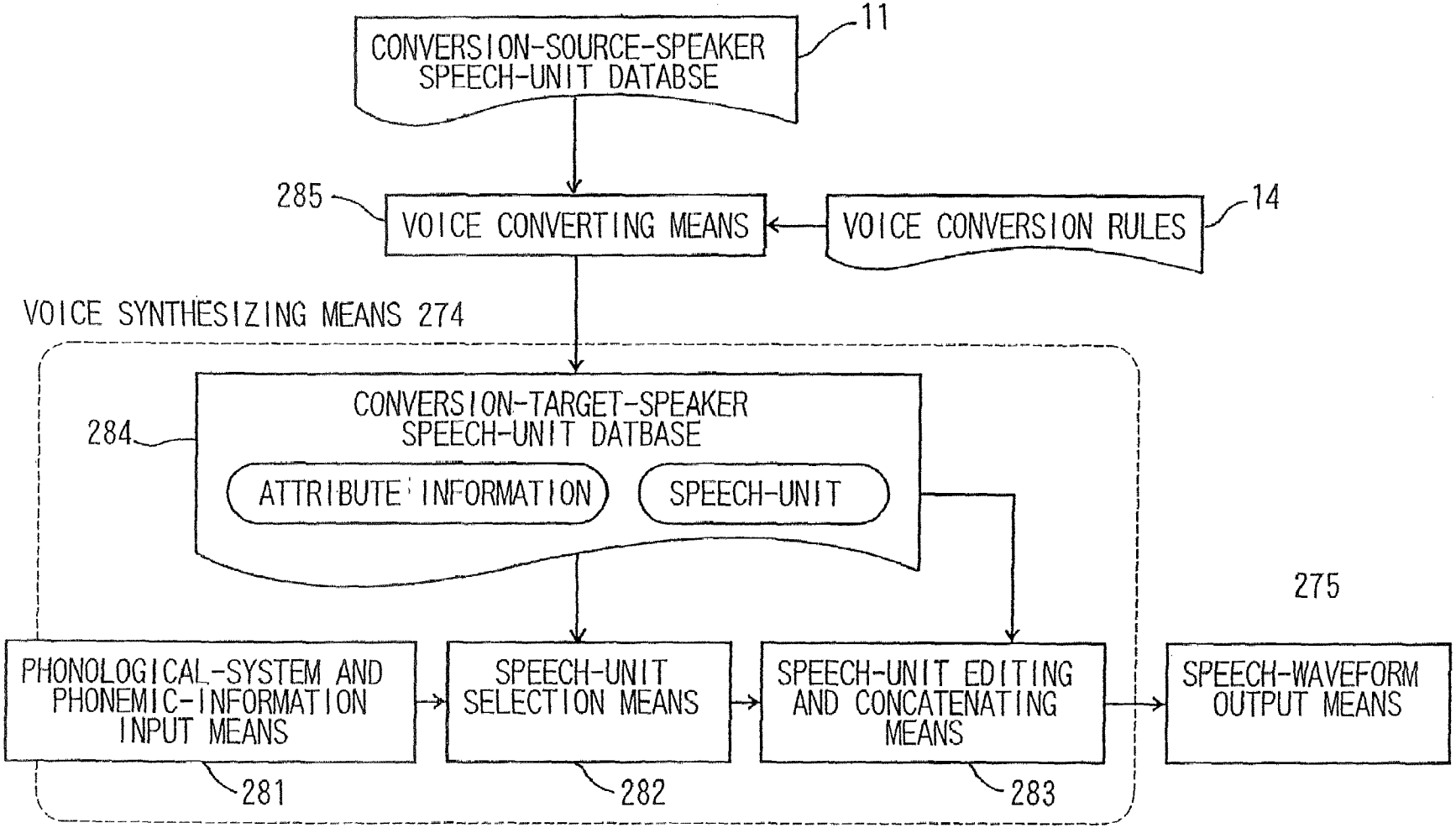
FIG. 28 is a block diagram showing the structure of a speech synthesis means.

FIG. 28 shows a structural example of the speech synthesizing means 274.

The speech synthesizing means 274 includes a phoneme sequence and prosodic-information input means 281, a speech-unit selection means 282, a speech-unit editing and concatenating means 283, a speech-waveform output means 275, and a speech unit database 284 that stores the speech-unit and attribute information of a conversion-target speaker.

According to this embodiment, the conversion-target-speaker speech-unit database 284 is obtained in such a way that a voice converting means 285 applies the voice conversion rules 14 made by the voice conversion according to the first embodiment to the conversion-source-speaker speech-unit database 11.

The conversion-source-speaker speech-unit database 11 stores speech-unit and attribute information that is divided in any types of speech unit and generated from the conversion-source-speaker speech data, as in the first embodiment. Pitch-marked waveforms of the conversion-source-speaker speech units are stored together with numbers for identifying the speech units, as shown in FIG. 6. The attribute information includes information used by the speech-unit selection means 282, such as phonemes (half phoneme names), fundamental frequency, phoneme duration, concatenation boundary cepstrum, and phonemic environment. The information is stored together with the numbers of the speech units, as shown in FIG. 7. The speech-unit and attribute information is generated from the conversion-source-speaker speech data by labeling, pitch marking, attribute generation, and speech-unit extraction, as in the process of the conversion-target-speaker speech-unit extracting means and the attribute generating means.

The voice conversion rules 14 have voice conversion rules made by the voice-conversion-rule making apparatus according to the first embodiment and converting the speech of the conversion-source speaker to that of the conversion-target speaker.

The voice conversion rules depend on the method of voice conversion.

As has been described in the first and second embodiments, when translation is used as a voice conversion rule, translation distance b found by Eq. (7) is stored.

With simple linear regression analysis, regression coefficients $a^k$ and $b^k$ obtained by Eq. (9) are stored.

With multiple regression analysis, regression matrix A obtained by Eq. (11) is stored.

With the VQ method, the centroid of each cluster and the regression matrix $A^c$ of each cluster are stored.

With the GMM method, GMM λ obtained by maximum likelihood estimation and the regression matrix $A^c$ of each mixture are stored.

(4-3) Voice Converting Means 285

Figure 29:
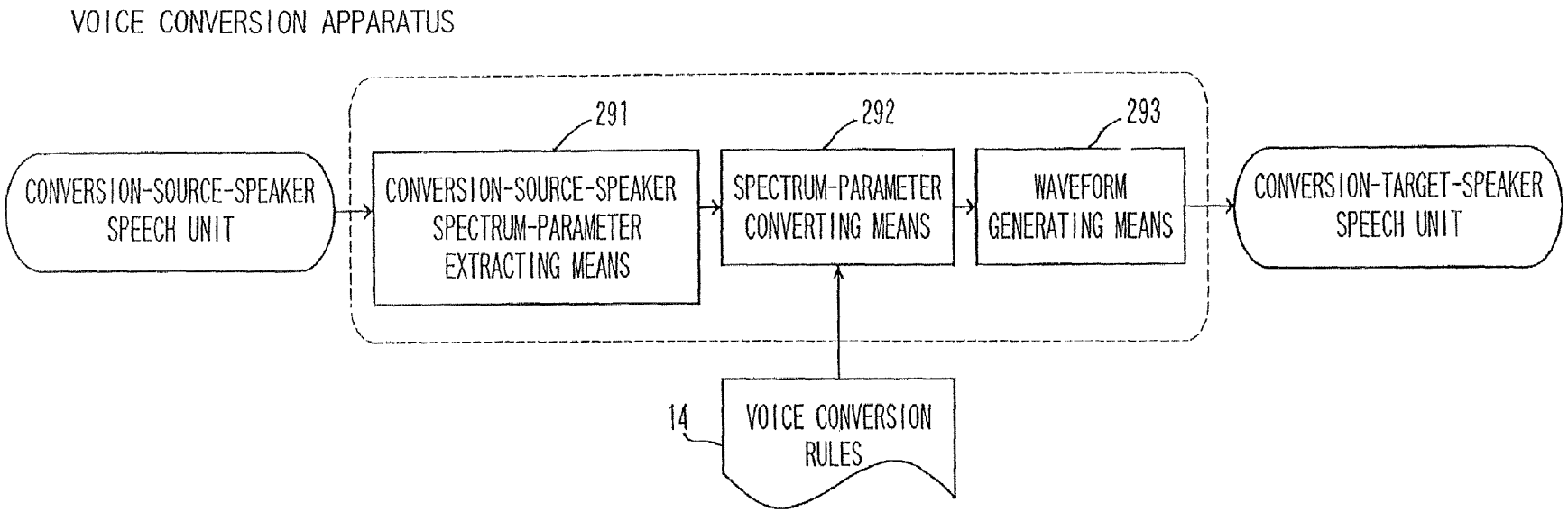
FIG. 29 is a block diagram showing the structure of a voice converting means.

The voice converting means 285 creates the conversion-target-speaker speech-unit database 284 that is converted to the voice quality of the conversion-target speaker by applying voice conversion rules to the speech units in the conversion-source-speaker speech-unit database. The voice converting means 285 converts the speech unit of the conversion-source speaker, as shown in FIG. 29.

(4-3-1) Conversion-Source-Speaker Spectrum-Parameter Extracting Means 291

The conversion-source-speaker spectrum-parameter extracting means 291 extracts pitch-cycle waveforms with reference to the pitch marks put on the speech unit of the conversion-source speaker, and extracts a spectrum parameter in a manner similar to the conversion-source-speaker spectrum-parameter extracting means 231 of FIG. 23.

(4-3-2) Spectrum-Parameter Converting Means 292 and Waveform Generating Means 293

The spectrum-parameter converting means 292 and the waveform generating means 293 convert the spectrum parameter using the voice conversion rules 14 to form a speech waveform from the converted spectrum parameter, thereby converting the voice quality, as with the spectrum-parameter converting means 232 and the waveform generating means 233 of FIG. 23 and the voice conversion of FIG. 25.

Thus, the speech units of the conversion-source speaker are converted to conversion-target-speaker speech units. The conversion-target-speaker speech units and corresponding attribute information are stored in the conversion-target-speaker speech-unit database 284.

The speech synthesizing means 274 selects a speech unit from the speech unit database 284 to synthesize speech. To the phoneme sequence and prosodic-information input means 281 is input phoneme sequence and prosodic information corresponding to the input text output from the phoneme processing means 273. The prosodic information input to the phoneme sequence and prosodic-information input means 281 includes a fundamental frequency and phoneme duration.

(5) Speech-Unit Selection Means 282

The speech-unit selection means 282 estimates the degree of the mismatch of synthesized speech for each speech means of the input phonological system based on the input phonemic information and the attribute information stored in the speech unit database 284, and selects speech unit from the speech units stored in the speech-unit database 284 according to the degree of the mismatch of the synthetic speech.

The degree of the mismatch of the synthetic speech is expressed as the weighted sum of a target cost that is a mismatch depending on the difference between the attribute information stored in the speech unit database 284 and the target speech-unit environment sent from the phoneme sequence and prosodic information input means 281 and a concatenation cost that is a mismatch based on the difference in speech-unit environment between concatenated speech units.

A subcost function $C_n(u_i, u_i-1, t_i)$ (n: 1 to N, where N is the number of the subcost functions) is determined every factor of the mismatch that occurs when speech units are modified and concatenated to generate synthetic speech. The cost function of Eq. (5) described in the first embodiment is for measuring the mismatch between two speech units, while the cost function defined here is for measuring the mismatch between the input phoneme sequence and prosodic information and the speech unit. Here, $t_i$ is target attribute information of a speech unit corresponding to the i-th unit if a target speech corresponding to input-phoneme sequence and input-prosodic information is t=(t1 to tI), and $u_i$ is a speech unit of the same phoneme as $t_i$, of the speech units stored in the conversion-target-speaker speech unit database 284.

The subcost functions are for calculating costs for estimating the degree of the mismatch between the synthetic speech generated using a speech unit stored in the conversion-target-speaker speech unit database 284 and a target speech. The target costs include a fundamental frequency cost indicative of the difference between the fundamental frequency of a speech unit stored in the conversion-target-speaker speech unit database 284 and a target fundamental frequency, a phoneme duration cost indicative of the difference between the phoneme duration of the speech unit and a target phoneme duration, and a phoneme environment cost indicative of the difference between the phoneme duration of the speech unit and target phoneme environment. As a concatenation cost, a spectrum concatenation cost indicative of the difference between spectrums at the boundary. Specifically, the fundamental frequency cost is expressed as:

$$C_1(u_i,u_{i-1},t_i)=\{\log(f(v_i))-\log(f(t_i))\}^2 \tag{16}$$

where $v_i$ is attribute information of speech unit $u_i$ stored in the conversion-target-speaker speech unit database 284, and $f(v_i)$ is a function to extract a average fundamental frequency from attribute information $v_i$.

The phoneme duration cost is calculated by $$C_2(u_i,u_{i-1},t_i)=\{g(v_i)-g(t_i)\}^2 \tag{17}$$

where $g(v_i)$ is a function to extract phoneme duration from the speech unit environment $v_i$.

The phoneme environment cost is calculated by $$C_3(u_i, u_{i-1}, t_i) = \begin{cases} 0 & \cdots \text{ Left phoneme environments match} \\ 1 & \cdots \text{ The other} \end{cases} \tag{18}$$

$$C_4(u_i, u_{i-1}, t_i) = \begin{cases} 0 & \cdots \text{ Right phoneme environments match} \\ 1 & \cdots \text{ The other} \end{cases}$$

which indicates whether the adjacent phonemes match.

The spectrum concatenation cost is calculated from the cepstrum distance between two speech units by the equation $$C_5(u_i,u_{i-1},t_i)=\|h(u_i)-h(u_{i-1})\| \tag{19}$$

where $h(u_i)$ indicates a function to extract the cepstrum coefficient at the concatenation boundary of the speech unit $u_i$ as a vector.

The weighted sum of the subcost functions is defined as a speech-unit cost function.

$$C(u_i, u_{i-1}, t_i) = \sum_{n=1}^{N} w_n C_n(u_i, u_{i-1}, t_i) \tag{20}$$

where $w_n$ is the weight of the subcost function. In this embodiment, all of $w_n$ are set to 1 for the sake of simplicity.

Eq. (20) represents the speech unit cost of a speech unit in the case where the speech unit is applied to a speech unit.

The sum of the results of calculation of a speech unit cost by Eq. (20) for each of the segments obtained by dividing an input phoneme sequence is called a cost. A cost function for calculating the cost is defined by Eq. (21).

$$\text{Cost} = \sum_{i=1}^{I} C(u_i, u_{i-1}, t_i) \tag{21}$$

The speech-unit selection means 282 selects a speech unit using the cost functions shown in Eqs. (16) to (21). Here, the speech-unit selection means 282 selects a speech unit sequence whose cost function calculated by Eq. (21) is the minimum from the speech units stored in the conversion-target-speaker speech unit database 284. The sequence of the speech units whose cost is the minimum is called an optimum speech unit sequence. In other words, each speech units in the optimum speech unit sequence corresponds to each of the units obtained by dividing the input phoneme sequence by synthesis unit, and the speech unit cost calculated from each speech unit in the optimum speech unit sequence and the cost calculated by Eq. (21) are smaller than those of any other speech unit sequence. The optimum unit sequence can be searched efficiently by dynamic programming (DP).

(6) Speech-Unit Editing and Concatenation Means 283

The speech-unit editing and concatenation means 283 generates a synthetic speech waveform by transforming and concatenating selected speech units according to input prosodic information. The speech-unit editing and concatenation means 283 extracts pitch-cycle waveforms from the selected speech unit and overlap-adds the pitch-cycle waveforms so that the fundamental frequency and phoneme duration of the speech unit become a target fundamental frequency and a target phoneme duration indicated in the input prosodic information, thereby generating a speech waveform.

(6-1) Details of Process

Figure 30:
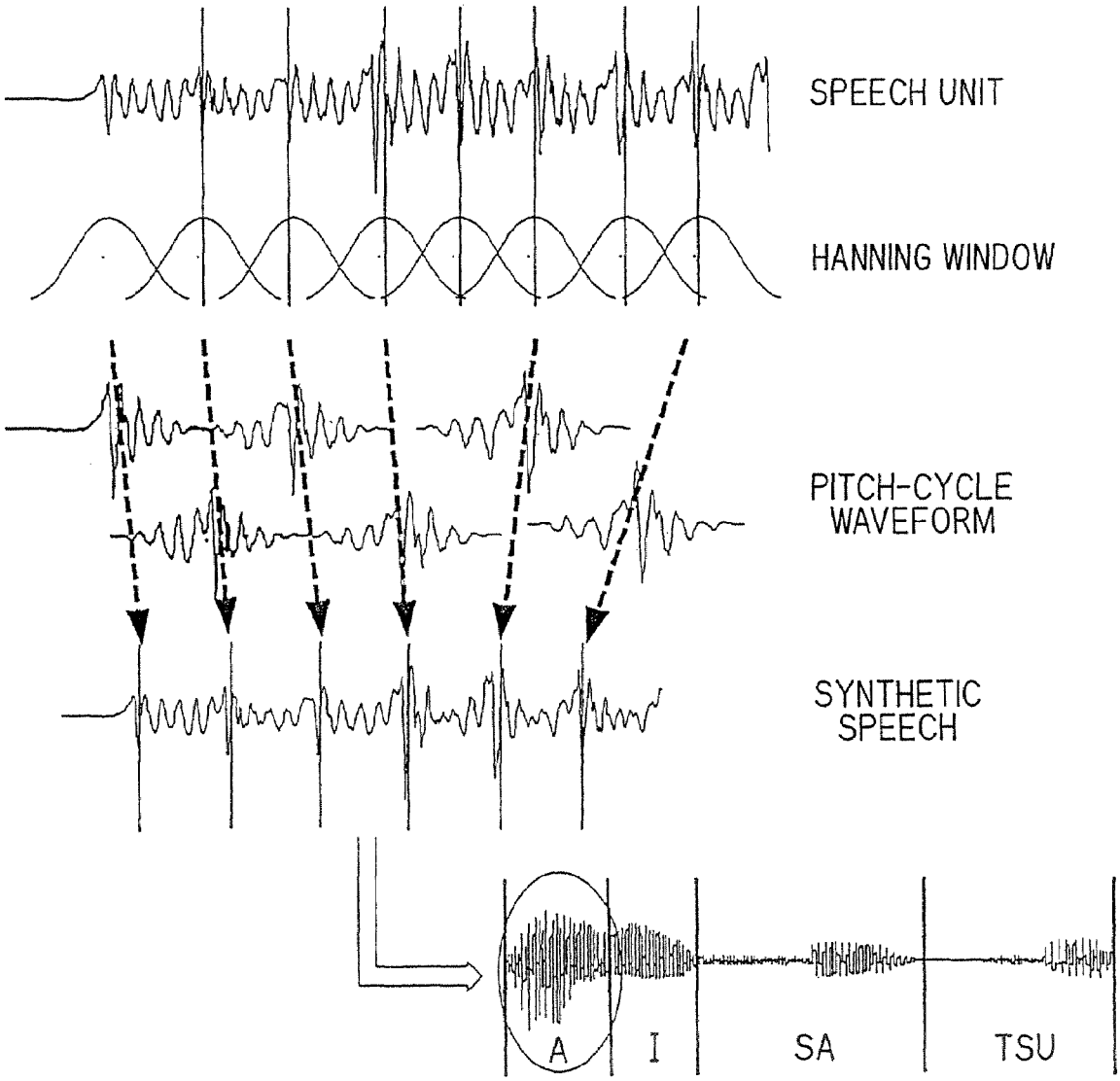
FIG. 30 is a diagram showing the process of a speech-unit editing and concatenation means.

FIG. 30 is an explanatory diagram of the process of the speech-unit editing and concatenation means 283.

FIG. 30 shows an example of generating the waveform of a phoneme "a" of a synthetic speech "a-i-sa-tsu", showing a selected speech unit, a Hanning window for extracting pitch-cycle waveforms, pitch-cycle waveforms, and synthetic speech from the top. The vertical bar of the synthetic speech indicates a pitch mark, which is produced according to a target fundamental frequency and a target phoneme duration in the input prosodic information. The speech-unit editing and concatenation means 283 overlap-adds the pitch-cycle waveforms extracted from a selected speech unit every arbitrary speech unit according to the pitch marks to thereby edit the speech unit, thus varying the fundamental frequency and the phoneme duration, and thereafter concatenates adjacent pitch-cycle waveforms to generate synthetic speech.

(7) Advantages

As has been described, according to the embodiment, unit-selection-type speech synthesis can be performed using the conversion-target-speaker speech-unit database converted according to the speech conversion rules made by the voice-conversion-rule making apparatus of the first embodiment, thereby generating synthetic speech corresponding to any input sentence.

More specifically, a synthetic speech of any sentence having the voice quality of a conversion-target speaker can be generated by creating a conversion-target-speaker speech-unit database by applying the voice conversion rules made using small units of data on a conversion-target speaker to the speech units in a conversion-source-speaker speech-unit database, and synthesizing speech from the conversion-target-speaker speech-unit database.

Furthermore, according to the embodiment, speech can be synthesized from a conversion-target-speaker speech-unit database obtained by applying the speech conversion rules according to the speech of any sentence of a conversion-target speaker and the speech conversion rules that reflect the information in a mass conversion-source-speaker speech-unit database, so that natural synthetic speech of the conversion-target speaker can be obtained.

(8) First Modification

While, in the embodiments, speech conversion rules are applied to the speech units in the conversion-source-speaker speech-unit database in advance, the speech conversion rules may be applied during synthesis.

Figure 31:
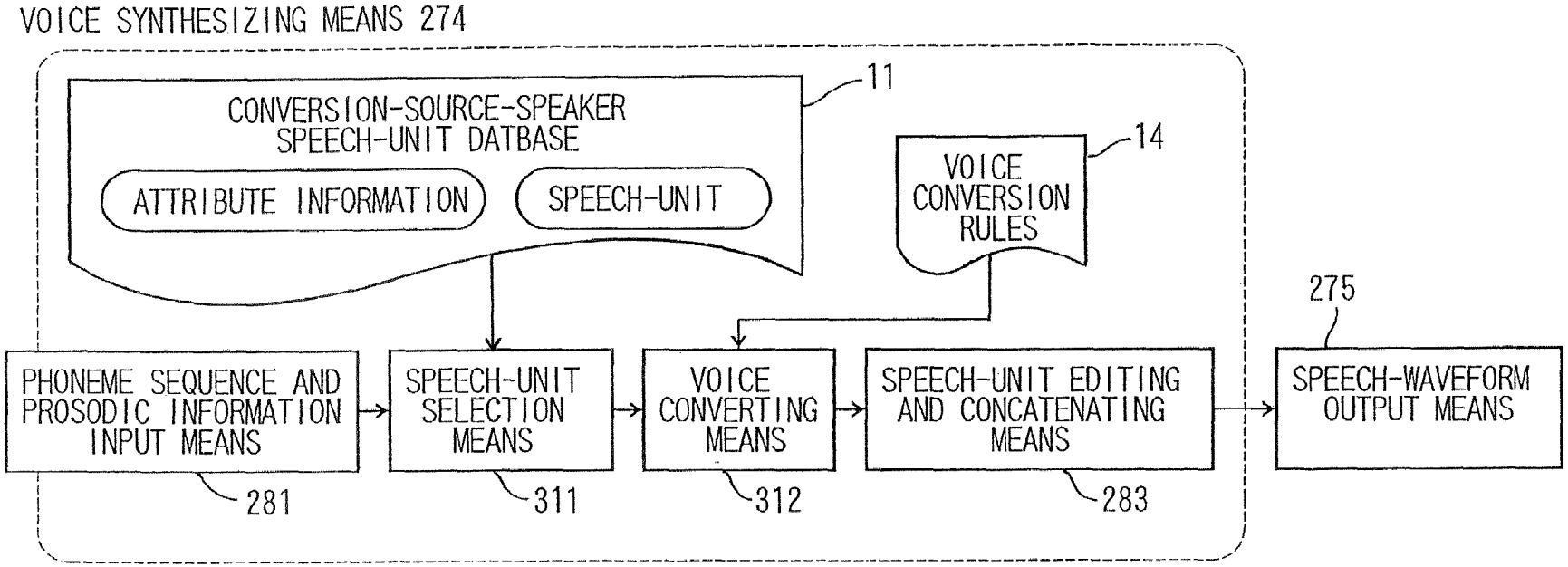
FIG. 31 is a block diagram showing the structure of the speech synthesizing means.

In this case, as shown in FIG. 31, the speech synthesizing means 274 stores the voice conversion rules 14 made by the voice-conversion-rule making apparatus according to the first embodiment together with the conversion-source-speaker speech-unit database 11.

During speech synthesis, the phoneme sequence and prosodic-information input means 281 inputs the phoneme sequence and prosodic information obtained by text analysis; a speech-unit selection means 311 selects a speech unit from the conversion-source-speaker speech-unit database so as to minimize the cost calculated by Eq. (21); and a voice converting means 312 converts the voice quality of the selected speech unit. The voice conversion by the voice converting means 312 can be the same as by the voice converting means 285 of FIG. 28. Thereafter, the speech-unit editing and concatenation means 283 changes and concatenates the phoneme of the converted speech units to thereby obtain synthetic speech.

According to the modification, the amount of calculation for speech synthesis increases because voice conversion process is added at speech synthesis. However, since the voice quality of the synthetic speech can be converted according to the voice conversion rules 14, there is no need to have the conversion-target-speaker speech unit database in generating synthetic speech using the voice quality of the conversion-target speaker.

Accordingly, in constructing a system for synthesizing speech using the voice quality of various speakers, the speech synthesis can be achieved only with the conversion-source-speaker speech-unit database and the voice conversion rules for the speakers, so that speech synthesis can be achieved with a smaller amount of memory than with speech unit database of all speakers.

Also, only conversion rules for a new speaker can be transmitted to another speech synthesizing system via a network, which eliminates the need for transmitting all the speech unit database of the new speaker, thereby reducing information necessary for transmission.

(9) Second Modification

While the invention has been described with reference to the embodiments in which voice conversion is applied to unit-selection type speech synthesis, it should be understood that the invention is not limited to that. The invention may be applied to plural-units selection and fusion type speech synthesis.

Figure 32:
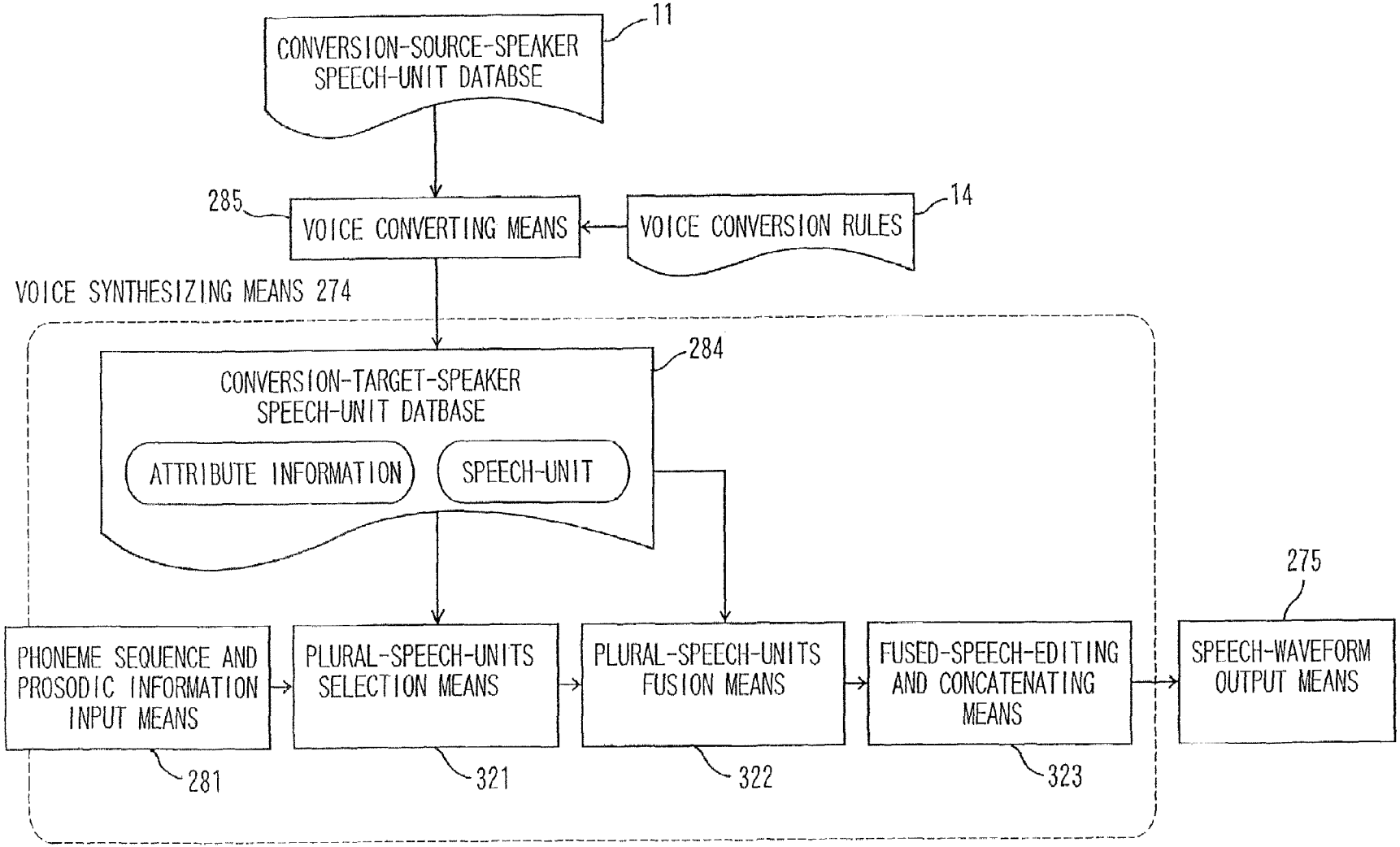
FIG. 32 is a block diagram showing the structure of the speech synthesizing means.

FIG. 32 shows a speech synthesizer of this case.

The voice converting means 285 converts the conversion-source-speaker speech-unit database 11 with the voice conversion rules 14 to create the conversion-target-speaker speech unit database 284.

The speech synthesizing means 274 inputs phoneme sequence and prosodic information that is the results of text analysis by the phoneme sequence and prosodic information input means 281.

A plural-speech-units selection means 321 selects a plurality of speech units on the speech unit segment from the speech unit database according to the cost calculated by Eq. (21).

A plural-speech-units fusion means 322 fuses the plurality of selected speech units to form fused speech units. A fused-speech-unit editing and concatenating means 323 changes and concatenates the fused speech units to form a synthetic speech waveform.

The process of the plural-speech-unit selection means 321 and the plural-speech-unit fusion means 322 can be performed by the method described in Patent Document 1.

The plural-speech-units selection means 321 first selects an optimum speech unit sequence with a DP algorithm so as to minimize the cost function of Eq. (21), and then selects a plurality of speech units from speech units of the same phoneme contained in the conversion-target-speaker speech unit database in an ascending order of the cost function, with the sum of the cost of concatenation with the optimum speech unit in the front and behind speech zone and a target cost of the attribute input to the corresponding zone.

The selected speech units are fused by the plural-speech-units fusion means to obtain a speech unit that represents the selected speech units. The unit fusion of speech units can be performed by extracting pitch-cycle waveforms from selected speech units, copying or deleting the pitch-cycle waveforms to match the number of the pitch-cycle waveforms with pitch marks generated from a target phoneme, and averaging the pitch-cycle waveforms corresponding to the pitch marks in time domain.

The fused-speech-unit editing and concatenating means 323 changes and concatenates the phonemes of the fused speech units to form a synthetic speech waveform. Since it has been confirmed that the speech synthesis of the plural-unit selection and fusion type can obtain more stable synthetic speech than the unit selection type, this arrangement enables speech synthesis of conversion-target speaker with high-stability and natural voice.

(10) Third Modification

The embodiments describe plural-units selection and fusion type speech synthesis that uses a speech unit database that is made in advance according to voice conversion rules. Alternatively, speech synthesis may be performed by selecting a plurality of speech units from a conversion-source-speaker speech unit database, converting the voice quality of the selected speech units, and fusing the converted speech units to thereby form fused speech units, and editing and concatenating the fused speech units.

Figure 33:
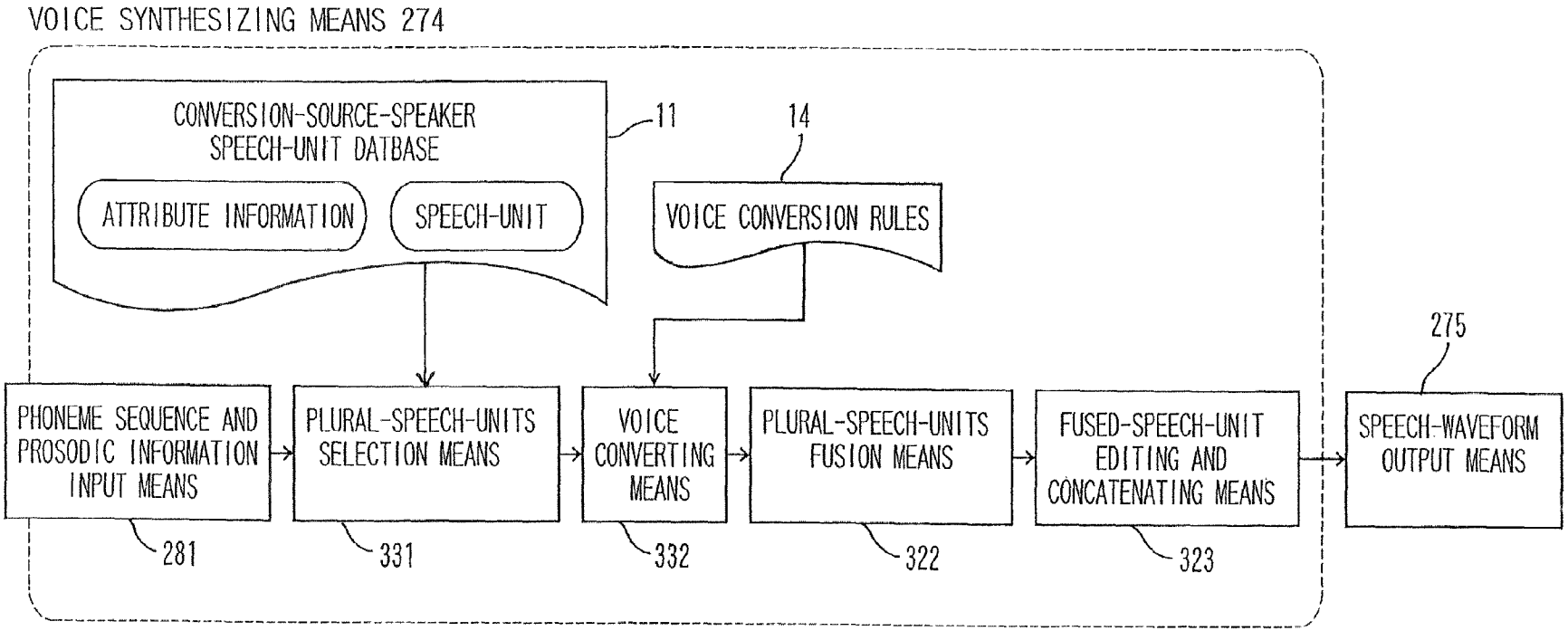
FIG. 33 is a block diagram showing the structure of the speech synthesizing means.

In this case, as shown in FIG. 33, the speech synthesizing means 274 stores the conversion-source-speaker speech-unit database 11 and the voice conversion rules 14 made by the voice-conversion-rule making apparatus according to the first embodiment.

At speech synthesis, the phoneme sequence and prosodic-information input means 281 inputs phoneme sequence and prosodic information that are results of test analysis; and a plural-speech-units selection means 331 selects a plurality of speech units on the speech unit segment from the conversion-source-speaker speech-unit database 11, as with the voice converting means 311 of FIG. 31.

The selected speech units are converted to speech units with the voice quality of the conversion-target speaker according to the voice conversion rules 14 by a voice converting means 332. The voice conversion by the voice converting means 332 is similar to that of the voice converting means 285 in FIG. 28. Thereafter, the plural-speech-unit fusion means 322 fuses the converted speech units, and the fused-speech-unit editing and concatenating means 323 changes and concatenates the phonemes to form a synthetic speech waveform.

According to the modification, the amount of calculation for speech synthesis increases because voice conversion process is added for speech synthesis. However, since the voice quality of the synthetic speech can be converted according to the stored voice conversion rules, there is no need to have the conversion-target-speaker speech unit database in generating synthetic speech using the voice quality of the conversion-target speaker.

Accordingly, in constructing a system for synthesizing speech using the voice quality of various speakers, the speech synthesis can be achieved only with the conversion-source-speaker speech-unit database and the voice conversion rules for the speakers, so that speech synthesis can be achieved with a smaller amount of memory than with speech unit database of all speakers.

Also, only conversion rules for a new speaker can be transmitted to another speech synthesizing system via a network, which eliminates the need for transmitting all the speech unit database of the new speaker, thereby reducing information necessary for transmission.

Since it has been confirmed that the speech synthesis of the plural-unit selection and fusion type can obtain more stable synthetic speech than the unit selection type, this modification enables speech synthesis of conversion-target speaker with high-stability and natural voice.

Figure 34:
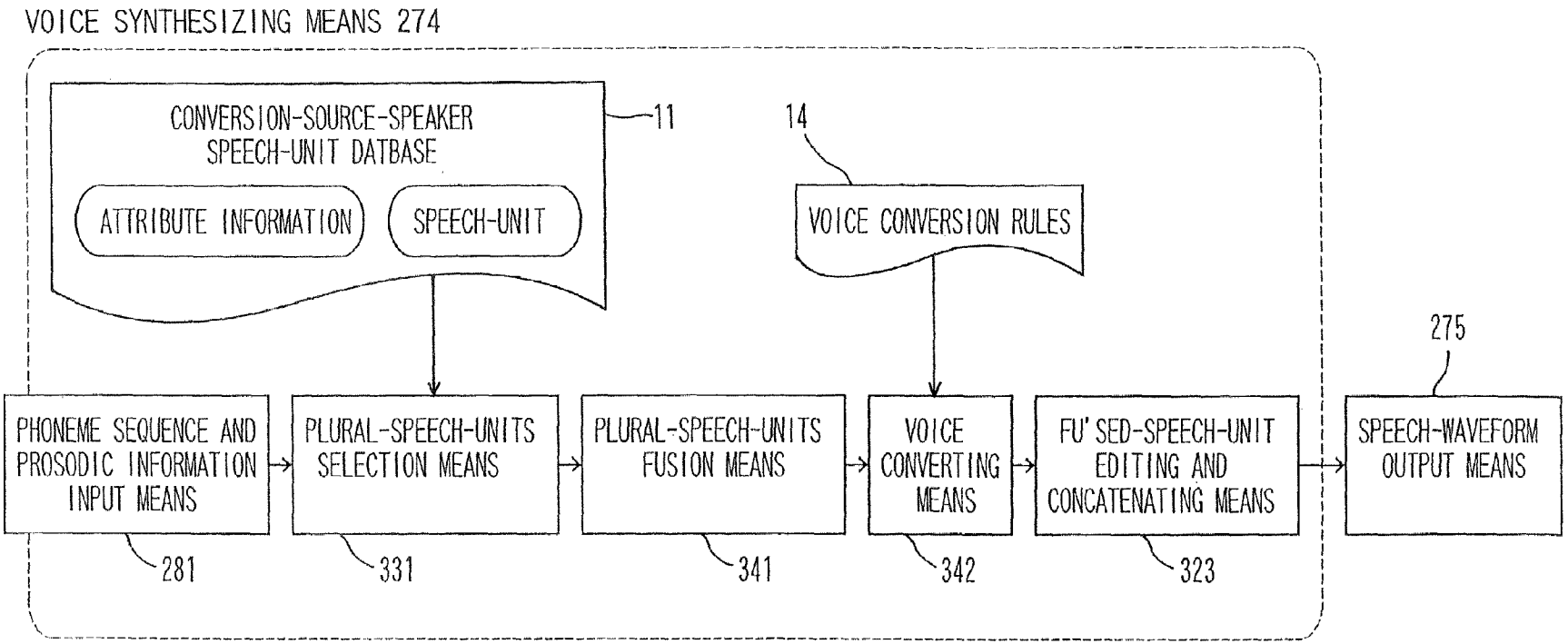
FIG. 34 is a block diagram showing the structure of the speech synthesizing means.

Although the speech-unit fusion process is performed after voice conversion, the voice quality of the pitch-cycle waveforms of the fused speech units may be converted after the fused speech units have been generated. In this case, as shown in FIG. 34, a plural-speech-unit fusion means 341 is provided before a voice converting means; a plurality of speech units of the conversion-source speaker are selected by the plural-speech-units selection means 331; the selected speech units are fused by the plural-speech-units fusing means 341; and the fused speech units are converted by a voice converting means 342 using the voice conversion rules 14; and the converted fused speech units are edit and concatenate by the fused-speech-unit editing and concatenating means 323, whereby synthetic speech is given.

(11) Fourth Modification

Although the embodiment applies the speech conversion rules made by the voice-conversion-rule making apparatus according to the first embodiment to the unit-selection-type speech synthesis and the plural-units selection and fusion type speech synthesis, the invention is not limited to that.

For example, the invention may be applied to a speech synthesizer (e.g., refer to Japanese Patent No. 3281281) based on close loop learning, one of unit-learning speech syntheses.

In the unit-learning speech syntheses, speech is synthesized in such a manner that representative speech units are learned and stored from a plurality of speech units or learning data, and the learned speech units are edited and concatenated according to input phoneme sequence and prosodic information. In this case, voice conversion can be applied in such a manner that the speech units or learning data are converted, from which representative speech units are learned. Also, the voice conversion may be applied to the learned speech units to form representative speech units with the voice quality of the conversion-target speaker.

(12) Fifth Modification

According to the embodiments, the attribute conversion rules made by the attribute-conversion-rule making means 194 may be applied.

In this case, the attribute conversion rules are applied to the attribute information in the conversion-source-speaker speech-unit database to bring the attribute information close to the attribute of the conversion-target speaker, whereby the attribute information close to that of the conversion-target speaker can be used for speech synthesis.

Furthermore, the prosodic information generated by the prosody processing means 273 may be converted by attribute conversion according to the attribute-conversion-rule making means 194. Thus, the prosody processing means 273 can generate prosody with the characteristics of the conversion-source speaker, and the generated prosodic information can be converted to the prosody of the conversion-target speaker, whereby speech synthesis can be achieved using the prosody of the conversion-target speaker. Accordingly, not only the voice quality but also the prosody can be converted

(13) Sixth Modification

According to the first to third embodiment, speech units are analyzed and synthesized based on pitch synchronous analysis. However, the invention is not limited to that. For example, since no pitch is observed in unvoiced segments, no pitch synchronizing process is allowed. In such segments, voice conversion can be performed by analysis synthesis using a fixed frame rate.

The fixed-frame-rate analysis synthesis may be adopted not only for the unvoiced segments. The unvoiced speech units may not converted but the speech units of the conversion-source speaker may be used as they are.

Modifications

It is to be understood by those skilled in the art that the invention is not limited to the first to third embodiments, but various modifications may be made by modifying the components without departing from the spirit and scope of the invention.

It will also be obvious that various changes and modifications may be achieved in combination of a plurality of components disclosed in the embodiments. For example, any several components may be eliminated from all the components of the embodiments.

It should also be understood that components of different embodiments may be combined as appropriate.

What is claimed is:

1. A speech processing apparatus comprising:

a speech storage configured to store a plurality of speech units of a conversion-source speaker and source-speaker attribute information corresponding to the speech units;

a speech-unit extractor configured to divide the speech of a conversion-target speaker into a predetermined type of a speech unit to form target-speaker speech units;

an attribute-information generator configured to generate target-speaker attribute information corresponding to the target-speaker speech units from the speech of the conversion-target speaker or linguistic information of the speech;

a speech-unit selector configured to calculate costs on the target-speaker attribute information and the source-speaker attribute information using cost functions, and selects one or a plurality of speech units with the same phoneme from the speech storage according to the costs to form a source-speaker speech unit; and a voice-conversion-rule generator configured to generate speech conversion functions for converting the one or the plurality of source-speaker speech units to the target-speaker speech units based on the target-speaker speech units and the one or the plurality of source-speaker-speech units.

2. The apparatus according to claim 1, wherein the speech-unit selector selects a speech unit corresponding to source-speaker attribute information in which the cost of the cost functions is the minimum from the speech storage into the source-speaker speech unit.

3. The apparatus according to claim 1, wherein the attribute information is at least one of fundamental frequency information, duration information, phoneme environment information, and spectrum information.

4. The apparatus according to claim 1, wherein the attribute-information generator comprises:

an attribute-conversion-rule generator configured to generate an attribute conversion function for converting the attribute information of the conversion-target speaker to the attribute information of the conversion-source speaker;

an attribute-information extractor configured to extract attribute information corresponding to the target-speaker speech units from the speech of the conversion-target speaker or the linguistic information of the speech of the conversion-target speaker; and an attribute-information converter configured to convert the attribute information corresponding to the target-speaker speech units using the attribute conversion function to use the converted attribute information as target-speaker attribute information corresponding to the target-speaker speech units.

5. The apparatus according to claim 4, wherein the attribute-conversion-rule generator comprises:

a analyzer configured to find an average of the fundamental frequency information of the conversion-target speaker and an average of the fundamental frequency information of the conversion-source speaker; and a difference generator configured to determine difference between the average of the fundamental frequency information of the conversion-target speaker and the average of the fundamental frequency information of the conversion-source speaker, and generates an attribute conversion function in which the difference is added to the fundamental frequency information of the conversion-source speaker.

6. The apparatus according to claim 1, wherein the voice-conversion-rule generator comprises:

a speech-parameter extractor configured to extract target-speaker speech parameters indicative of the voice quality of the target-speaker speech units and source-speaker speech parameters indicative of the voice quality of the source-speaker speech units; and a regression analyzer configured to obtain a regression matrix for estimating the target-speaker speech parameters from the source-speaker speech parameters, the regression matrix being the voice conversion function.

7. The apparatus according to claim 1, further comprising:

a voice converter configured to convert the voice quality of the speech of the conversion-source speaker using the voice conversion function.

8. The apparatus according to claim 1, further comprising:

a speech-unit storage configured to store conversion-target-speaker speech units obtained by converting the conversion-source-speaker speech units with the voice conversion function;

a speech-unit selector configured to select speech units from the speech-unit storage to obtain representative speech units; and a speech-waveform generator configured to generate a speech waveform by concatenating the representative speech units.

9. The apparatus according to claim 1, further comprising:

a speech-unit selector configured to select speech units from the speech-unit storage to obtain representative conversion-source-speaker speech units;

a voice converter configured to convert the representative conversion-source-speaker speech units using the voice conversion function to obtain representative conversion-target-speaker speech units; and a speech-waveform generator configured to concatenate the representative conversion-target-speaker speech units to generate a speech waveform.

10. The apparatus according to claim 1, further comprising:

a speech-unit storage configured to store conversion-target-speaker speech units obtained by converting the conversion-source-speaker speech units with the voice conversion function;

a plural-speech-units selector configured to select a plurality of speech units for each synthesis unit from the speech-unit storage;

a fusion unit configured to fuse the selected plurality of speech units to form fused speech units; and a speech-waveform generator configured to concatenate the fused speech units to generate a speech waveform.

11. The apparatus according to claim 1, further comprising:

a plural-speech-units selector configured to select a plurality of speech units for each synthesis unit from the speech-unit storage;

a voice converter configured to convert the selected plurality of speech units using the voice conversion function to obtain a plurality of conversion-target-speaker speech units;

a fusion unit configured to fuse the selected plurality of conversion-target-speaker speech units to form fused speech units; and a speech-waveform generator configured to concatenate the fused speech units to generate a speech waveform.

12. A method of processing speech, the method comprising:

storing in a storing means a plurality of speech units of a conversion-source speaker and source-speaker attribute information corresponding to the speech units;

dividing the speech of a conversion-target speaker into a predetermined type of a speech unit to form target-speaker speech units;

generating target-speaker attribute information corresponding to the target-speaker speech units from information on the speech of the conversion-target speaker or linguistic information of the speech;

calculating costs on the target-speaker attribute information and the source-speaker attribute information using cost functions, and selecting one or a plurality of speech units with the same phoneme from the storing means according to the costs to form a source-speaker speech unit; and generating voice conversion functions for converting the one or the plurality of source-speaker speech units to the target-speaker speech units based on the target-speaker speech units and the one or a plurality of source-speaker speech units.

13. A computer-readable storage medium having stored therein a program for processing speech, the program causing a computer to implement a process comprising:

storing a plurality of speech units of a conversion-source speaker and source-speaker attribute information corresponding to the speech units;

dividing the speech of a conversion-target speaker into a predetermined type of a speech unit to form target-speaker speech units;

generating target-speaker attribute information corresponding to the target-speaker speech units from information on the speech of the conversion-target speaker or linguistic information of the speech;

calculating costs on the target-speaker attribute information and the source-speaker attribute information using cost functions, and selecting one or a plurality of speech units with the same phoneme from the conversion-source-speaker speech units according to the costs to form a source-speaker speech unit; and generating voice conversion functions for converting the one or a plurality of source-speaker speech units to the target-speaker speech units based on the target-speaker speech units and the one or the plurality of source-speaker speech units.

* * * * *